US006173136B1

(12) United States Patent
Fuchiwaki et al.

(10) Patent No.: US 6,173,136 B1
(45) Date of Patent: Jan. 9, 2001

(54) FUSER FOR TWO-SIDED IMAGER

(75) Inventors: Takashi Fuchiwaki; Akihisa Maruyama; Yasutomo Ishii; Katsuya Takenouchi; Keitaro Sonoguchi; Yasutaka Naito; Yasuyuki Kobayashi; Yoko Shimomura; Kazuhiko Miyazato; Shigehiko Haseba; Minoru Ueki; Satoshi Matsuzaka, all of Ebina (JP)

(73) Assignee: Fuji Xerox Co., Ltd., Tokyo (JP)

( * ) Notice: Under 35 U.S.C. 154(b), the term of this patent shall be extended for 0 days.

(21) Appl. No.: 09/365,802

(22) Filed: Aug. 3, 1999

(30) Foreign Application Priority Data

Aug. 11, 1998 (JP) ..... 10-227298

(51) Int. Cl.[7] ..... G03G 15/20
(52) U.S. Cl. ..... 399/67; 399/325
(58) Field of Search ..... 399/67, 68, 69, 399/328, 324, 325, 302, 308, 309; 219/216

(56) References Cited

U.S. PATENT DOCUMENTS 5,132,739 * 7/1992 Mauer et al. ..... 399/325
5,732,316 * 3/1998 Yamasaki et al. ..... 399/67 X
5,991,563 * 11/1999 Haneda et al. ..... 399/68

FOREIGN PATENT DOCUMENTS 5-323704 12/1993 (JP) .
7-271134 10/1995 (JP) .
8-234606 9/1996 (JP) .

* cited by examiner

*Primary Examiner*—Arthur T. Grimley
*Assistant Examiner*—Hoan Tran
(74) *Attorney, Agent, or Firm*—Oliff & Berridge, PLC

(57) ABSTRACT

Image deterioration (so-called oil ghost) due to local transfer of a release agent from a fuser to an intermediate transfer body is effectively prevented. The fuser has a pair of fixing members, a release supply mechanism, an interlocking mechanism, and an interlocking control mechanism. The fixing members are in contact with each other and roll over each other, thus nipping a sheet. The fixing members fix unfixed images on the sheet. The release agent supply mechanism is mounted to at least the fixing member located on the surface of the sheet carrying an unfixed image. The release agent supply mechanism supplies a release agent to this fixing member at a constant rate. The interlocking mechanism interlocks the fixing members and release agent supply mechanism with each other such that the fixing members are kept in contact with each other and roll over each other and that a release agent is supplied to the fixing members. When duplex mode is selected, the interlocking control mechanism controls the interlocking time of the interlocking mechanism according to the length of the path of the sheet going to the nip between the fixing members.

22 Claims, 21 Drawing Sheets

AUTO DUPLEX, SAME IMAGE REPEATS

AUTO DUPLEX, SAME IMAGE REPEATS

SIMPLEX, WHOLE SURFACE IS HALF-TONED

FUSER FOR TWO-SIDED IMAGER

BACKGROUND OF THE INVENTION

1. Field of the Invention

The present invention relates to a two-sided imager for creating images on both sides of a sheet and, more particularly, to improvements in a fuser used in a two-sided imager in which an unfixed image on an image carrier is transferred to a sheet via an intermediate transfer body, and in which unfixed images formed on both sides of a sheet in turn are fixed separately by the fuser.

2. Description of the Related Art

A conventional imager of the intermediate transfer type is described, for example, Japanese Patent Laid-Open No. 323704/1993. This imager has a latent image carrier as consisting of a photoconductor (PC) drum. Developing units for various color components such as black (Bk), yellow (Y), magenta (M), and cyan (C) are mounted around the drum. An intermediate transfer body in the form of a belt, for example, is placed opposite to the latent image carrier. Whenever the latent image carrier makes one revolution, unfixed toner images of each color component formed on the latent image carrier are transferred onto the intermediate transfer body in turn (primary transfer). Then, the composite primary transfer image on the intermediate transfer body is transferred onto paper or sheet such as an OHP slip-sheet (secondary transfer), thus forming a desired image on the sheet.

With this type of machine, the composite toner image consisting of multiple toner images already transferred to the intermediate transfer body is transferred to the sheet at once. Therefore, this machine has the advantage that disturbance of the image and color misregistration can be effectively prevented during the multiple transfer without the need to take account of the thickness of the sheet, the surface characteristics, and the transportation characteristics of the sheet over the latent image carrier.

Some of imagers of this kind create images on both sides of a sheet. These two-sided imagers perform the following sequence of operations. In the duplex mode, an unfixed toner image transferred to one side of a sheet (front surface) is fixed by a fuser. Then, the sheet is reversed via a sheet return-and-reverse mechanism. Subsequently, the sheet is sent back to the secondary transfer position. A composite primary transfer image that is formed on the intermediate transfer body and is an image formed on the rear side of the sheet is secondary transferred to the other side (rear surface) of the sheet. Then, the image is fixed by the fuser.

The fuser has a pair of fixing rolls that are in contact with each other and roll over each other. One of the rolls is a heating fixing roll, while the other is a pressure fixing roll pressed against the heating roll. The sheet is passed through the nip between the fixing rolls. As a result, the unfixed toner on the sheet is fixed. To prevent so-called offset phenomenon (i.e., the toner image on the sheet transfers to the fixing rolls), an oil (e.g., a silicone oil) acting as a release agent is normally supplied to the fixing rolls by a release agent supply device. This method is generally employed.

With respect to the amount of the supplied release agent, it is possible to control the amount of the supplied release agent from the release agent supply device according to the amount of the release agent applied to the fixing rolls. However, to simplify the structure of the machine, a given amount of release agent is supplied, because this is a straightforward method.

In the both-sided imager of the intermediate transfer type of this kind, if a large-area, half-toned image is created in the simplex mode after the same image is printed or copied repeatedly (e.g., about 50 times) in the auto duplex mode, then the density of the image portion repeatedly printed in the auto duplex mode becomes lower than the other portions. This tends to produce a residual image, which may hereinafter be referred to as oil ghost. This phenomenon was considered a technical problem.

We have investigated causes of the oil ghost and arrived at the following conclusion.

It is assumed that a two-sided imager creates the same image repeatedly in the auto duplex mode. This imager has fusers including a fuser located on the side of the heating roll. Only this fuser is equipped with a release agent supply device that supplies a constant amount of release agent 303.

If an unfixed image is created on one side (front surface) of a sheet 300, as shown in FIG. 21(*a*), and if this sheet 300 is passed through the fuser 301, the release agent 303 adheres to the substantial whole of the other side (rear surface) of the sheet 300 because the release agent 303 is supplied also to the heating fixing roll 302 of the fuser 301.

When transfer is made to the rear surface of the sheet 300, the sheet 300 having one side already fixed is again passed through the secondary transfer position. At this time, as shown in FIG. 21(*b*), the release agent 303 adhering to the rear surface of the sheet 300 transfers to an intermediate transfer body 304, corresponding to a nonimage area 305, i.e., the area of the sheet 300 excluding an unfixed image (image area) 306 on the intermediate transfer body 304 for the rear surface.

Where the same image is printed or copied repeatedly, the release agent 303 is hardly supplied to an area of the intermediate transfer body 304 corresponding to the image area 306. It follows that the release agent 303 transfers only to the area corresponding to the nonimage area 305. Consequently, the transfer efficiency in the nonimage area 305 becomes much higher than that in the image area 306.

Under this condition, if a large-area, half-toned image is created in the simplex mode as shown in FIG. 21(*c*), the area corresponding to the image area 306 in the auto duplex mode appears as a half-toned image 307 of a low gray level, and the area corresponding to the nonimage area 305 appears as a half-toned image 308 of a high gray level, possibly because the area corresponding to the image area 306 in the auto duplex mode is lower in transfer efficiency than the other area corresponding to the nonimage area 305 in the auto duplex mode. It appears that this gives rise to negative ghost.

Especially, where the full-color mode of the aforementioned duplex imager for creation of full-color images is selected, the sheet transported through the fuser normally takes a longer path than where the monochrome printing mode is selected. The amount of the release agent transferring to the pressure roll from the surface of the heating roll of the fuser is increased accordingly. Hence, the aforementioned oil ghost phenomenon appears more conspicuously.

In the case of a duplex imager equipped with plural image carrier areas and thus having plural intermediate transfer bodies, images in the image carrier areas on the intermediate transfer bodies are successively transferred to plural sheets. These sheets are passed through the fuser in succession.

If the plural sheets successively pass through the fuser, this fuser is required to fix the images without offset. Therefore, the amount of the supplied release agent must be increased compared with the case in which there is only one image carrier area. In consequence, the above-described oil ghost phenomenon appears more conspicuously.

SUMMARY OF THE INVENTION

In an attempt to solve the technical problems described above, the present invention has been made.

It is an object of the present invention to provide a fuser which is for use in a two-sided imager and which can effectively prevent image quality deterioration (so-called oil ghost phenomenon) that would normally be caused by local transfer of a release agent from the fuser to the intermediate transfer body.

Referring to FIG. 1, a two-sided imager in accordance with the present invention comprises an imaging unit 1, a fuser 5, and a sheet return-and-transport mechanism 6. An unfixed image is formed on an image carrier 2 and transferred to a sheet 4 by the imaging unit 1 via an intermediate transfer body 3. The fuser 5 fixes the unfixed image formed on the sheet 4 by the imaging unit 1. The sheet return-and-transport mechanism 6 reverses the sheet 4 that has one side fixed and has been passed through the fuser 5. The mechanism 6 sends the sheet back to the sheet transfer location of the imaging unit 1. In the duplex mode, unfixed images formed successively on both sides of the sheet 4 are separately fixed by the fuser 5. This fuser 5 comprises a pair of fixing members 5*a*, 5*b*, a release agent supply means 7 fitted at least to the fixing member 5*a*, an interlocking mechanism 8, and a control means 9. The fixing members 5*a* and 5*b* are in contact with each other and roll over each other. These fixing members 5*a* and 5*b* cooperate to nip and transport the sheet 4. The fixing members 5*a* and 5*b* fix the unfixed images on the sheet 4. The fixing member 5*a* is located on the side of the sheet 4 that carries the unfixed image. The release agent supply means 7 supplies a constant amount of release agent to the fixing member 5*a*. The interlocking mechanism 8 maintains the fixing members 5*a* and 5*b* in contact with each other so as to roll over each other. The interlocking mechanism 8 interlocks the fixing members 5*a*, 5*b* and the release agent supply means 7 with each other in such a way that the release agent is supplied to the fixing members 5*a* and 5*b*. In the duplex mode, the control means 9 controls the interlocking time of the interlocking mechanism 8 according to the length of the path of the sheet 4 going to the nip between the fixing members 5*a* and 5*b*.

In these technical means, the imaging unit 1 in according with the invention may have one or more image carriers 2 as long as the intermediate transfer body 3 is located opposite to the image carrier or carriers 2. The image carriers 2 and the intermediate transfer body 3 may be in the form of a drum or a belt. Unfixed images may be formed by electrophotography, electrostatic photography, or any other method.

The imaging unit 1 in accordance with the invention is not limited to one that creates full-color images. The imaging unit 1 may create two-color images, three-color images, or other plural-color images. Furthermore, the imaging unit 1 may create single-color images. Various image creation modes may be selected at will.

The fuser 5 is only required to have a pair of fixing members 5*a*, 5*b* that nip and transport the sheet 4. Typically, the fixing members are rolls located opposite to each other. They may be a combination of a roll and a belt. In addition, they may be a pair of belts.

Typically, one fixing member 5*a* is a heating member, and the other fixing member 5*b* is a pressure application member pressed against the heating member 5*a*. In this case, to improve the fixing performance, an external heat source may be attached to the fixing member 5*a* that is a heating member. A heat source may be attached to the fixing member 5*b* that is a pressure application member. In this way, appropriate design modifications may be made.

Any arbitrary sheet return-and-transport mechanism may be used as the sheet return-and-transport mechanism 6 as long as it reverses the sheet 4 having one side unfixed and passed through the fuser 5 and returns the sheet to the sheet transfer location of the imaging unit 1. In order to operate the machine at high speed in the duplex mode, any intermediate tray holding the sheet 4 temporarily is not formed; preferably, the sheet 4 passed through the fuser 5 and having one side unfixed is reversed and immediately returned to the sheet transfer location (so-called intermediate trayless system).

Where the intermediate trayless system is adopted and the sheet 4 having one side unfixed and passed through the fuser 5 is returned to the sheet transfer location in a relatively short time, the present invention suppresses the amount of release agent adhering to the second surface (rear surface) of the sheet 4 having one side fixed. Also, the amount of release agent transferred to the intermediate transfer body 3 can be reduced.

With respect to the release agent supply means 7, it may be attached to each of the fixing members 5*a*, 5*b* if the supply means can supply a release agent such as a silicone oil for preventing offset phenomenon. However, where ease of control of the amount of the release agent on each of the fixing members 5*a*, 5*b* and simplification of the structure of the fuser 5 are taken into consideration to save space and cost, it is desired to mount the release agent supply means 7 only to the fixing member 5*a* on the side of the sheet 4 carrying an unfixed image. A given amount of release agent is supplied to the fixing member 5*a*. The release agent is indirectly supplied to the other fixing member 5*b* via the fixing member 5*a*.

Any appropriate release agent supply means may be selected as the release agent supply means 7 as long as it can supply a given amount of release agent to the fixing member 5*a* or 5*b*. The supply means may supply a release agent from inside a container to the fixing member via a supply member. The supply means may use a supply member previously impregnated with a release agent, and a given amount of release agent is supplied to the supply member.

Furthermore, any desired interlocking member may be used as the interlocking mechanism 8 as long as it interlocks the pair of fixing members 5*a*, 5*b* and the release supply means 7 with each other in such a way that the pair of fixing members 5*a* and 5*b* roll over each other in contact with each other and that a release agent is supplied to the pair of fixing members 5*a* and 5*b*.

One typical example of the interlocking mechanism 8 moves the pair of fixing members 5*a* and 5*b* into and out of contact with each other. When they are in contact with each other, the interlocking member maintains the pair of fixing members 5*a*, 5*b* and the release agent supply means 7 interlocked.

At this time, the release agent supply means 7 is required that it be normally in contact with the fixing member 5*a* or 5*b* to which the release agent is directed. Both fixing members 5*a* and 5*b* may be movable back and forth. However, where simplification of the interlocking mechanism 8 is taken into account, it is desired that only one fixing member 5*b* be able to move back and forth into and out of contact with the other fixing member. In addition, a rotationally driving means may be mounted to each of the fixing members 5*a* and 5*b* to rotationally drive them during or before the contact. Alternatively, a rotationally driving means may be mounted to only one of the fixing members 5*a* and 5*b*. In this case, this one fixing member 5*a* or 5*b* is rotationally driven during or before the contact. When they are in contact with each other, the other fixing member 5*b* or 5*a* may be made to follow the rotation of one fixing member 5*a* or 5*b*.

As a second example, the fixing members 5*a* and 5*b* can be driven and stopped while kept in contact with each other. When they are being driven, the fixing members 5*a*, 5*b* and the release agent supply means 7 are kept interlocked.

At this time the release agent supply means 7 may be normally kept in contact with the fixing member 5*a* or 5*b* to which the release agent is supplied. To drive the fixing members 5*a* and 5*b*, a power-disconnecting means such as a clutch is mounted between the pair of fixing members 5*a*, 5*b* and the driving power source. The timing at which the power-disconnecting means is engaged or disengaged is appropriately controlled.

As a third example, the release agent supply means 7 is brought into and out of contact with the fixing member 5*a* or 5*b*. When they are in contact with each other, the fixing members 5*a*, 5*b* and the release agent supply means 7 are kept interlocked.

At this time, the pair of fixing members 5*a* and 5*b* are kept in contact and in driving operation. Only the release agent supply means 7 is moved into and out of contact with the fixing member at appropriate timing.

With respect to the control of the interlocking time of the interlocking mechanism 8 under control of the interlocking control means 9, any desired control method may be selected if it is suitable for the length of the path of the sheet 4 reaching the nip between the fixing members 5*a* and 5*b* in the duplex mode.

One example of the method of controlling the interlocking control means 9 consists of temporarily canceling the interlocking state of the interlocking mechanism 8 if the length of the path of the sheet 4 going to the nip between the fixing members 5*a* and 5*b* exceeds a preset maximum allowable length in the duplex mode, for example.

At the preset maximum allowable length, the interlocking state is not required to be canceled. The timing at which the interlocking state provided by the interlocking mechanism 8 is canceled temporarily may be set irrespective of or according to the length of the path. In the latter case, the timing at which the interlocking state is canceled temporarily may be set to plural levels according to the length of the path of the sheet 4.

More particularly, it is assumed that the fuser used in the two-sided imager has a length of path of the sheet 4 going to the nip between the fixing members 5*a* and 5*b*, and that this length of path differs between full-color mode and monochrome mode. If the full-color mode is selected in the duplex mode, the interlocking control means 9 sets the interlocking time of the interlocking mechanism 8 shorter than where the monochrome mode is selected.

In the duplex monochrome mode, the interlocking control means 9 may maintain the interlocking state of the interlocking mechanism 8 after the sheet 4 passes through the fuser 5, for the following reason.

If the monochrome mode is selected in the duplex mode, the length of the path of the sheet 4 going to the nip between the fixing members 5*a* and 5*b* is normally shorter than in the full-color mode and so the sheet 4 makes more passes. Accordingly, the release agent on the fixing members 5*a* and 5*b* are more effectively absorbed into the sheet 4. The amount of the release agent on the fixing member 5*b* stabilizes at an amount smaller than in the full-color mode.

Conversely, if the full-color mode is selected in the duplex mode, the interlocking control means 9 may temporarily cancel the interlocking state of the interlocking mechanism 8 after the sheet 4 passes through the fuser 5, for the following reason.

Where the full-color mode is selected in the duplex mode, the length of the path of the sheet 4 going to the nip between the fixing members 5*a* and 5*b* is greater than in the monochrome mode. Therefore, if the interlocking state of the interlocking mechanism 8 is maintained at all times, then an excessive amount of release agent transfers to the nonimage side of the sheet 4 during fixing of the first image. As a result, it is inevitable that an excessive amount of release agent is transferred to the intermediate transfer body 3.

In another control method for the interlocking control means 9, the interlocking time of the interlocking mechanism 8 is made different between when the first image is fixed and when the second image is fixed, for example, where the duplex mode is selected. In this case, if a larger amount of release agent transfers to the nonimage side of the sheet 4 during fixing of the first image, there is a possibility that more release agent on the sheet 4 is transferred to the intermediate transfer body 3 during fixing of the second image. Therefore, the interlocking time of the interlocking mechanism 8 during fixing of the first image is set shorter than the interlocking time during fixing of the second image.

At the beginning of the use of the fuser 5, the amounts of release agent on the pair of fixing members 5*a* and 5*b* may be set separately. However, where the stability of the amounts of release agent on the pair of fixing members 5*a* and 5*b* and the ease of control of the supplied amounts of release agent are taken into consideration, it is desired to control the interlocking time of the interlocking mechanism 8 such that the amounts of release agent on the fixing members 5*a* and 5*b* be made equal at the beginning of the use of the fuser 5.

The amounts of release agent necessary for the each fixing members 5*a* and 5*b* are now discussed. First, the amount of release agent necessary for the fixing member 5*b* located on the opposite side of the unfixed image-holding surface is discussed. As control is provided by the interlocking control means 9, the second and following sheets 4 pass through the fuser 5. Under this condition, so-called oil ghost phenomenon should be prevented where an ordinary number of documents are copied or printed at random continuously (referred to as normal use conditions). For this purpose, it is desired to set the amount of release agent for the fixing member 5*b* to equal or less than 3.0 $\mu$l/A4 size. Especially, where the aforementioned oil ghost should be avoided with certainty under stringent conditions (condition in which oil ghost tend to occur, e.g., 100 copies of the same document are continuously made in the auto duplex mode, in a high-humidity environment, or fully water-moistened sheets are used), the amount of release agent for the fixing member 5*b* is preferably set to equal or less than 1.5 $\mu$l/A4 size.

With respect to the amount of release agent for the fixing member 5*b* during fixing of the second image, it is not necessary to take account of the so-called oil ghost phenomenon. However, winding of the sheet 4 around the fixing member 5*b* should be effectively prevented. Also, offset development (nonuniform melting) of fixed image located on the fixing member 5*b* should be effectively prevented. Therefore, during fixing of the second image, the amount of release agent on the side of the fixing member 5*b* is preferably set to equal or more than 0.5 μl/A4 size, more preferably equal or more than 0.7 μl/A4 size.

The fixing member 5*a* located on the unfixed image-holding surface is now discussed. As control is provided by the interlocking control means 9, the second and following sheets 4 pass through the fuser 5. Under this condition offset phenomenon on the unfixed image on the sheet 4 onto the fixing member 5*a* should be effectively prevented. Furthermore, transfer of the release agent to the other fixing member 5*b* should be taken into consideration. The so-called oil ghost phenomenon should be prevented under normal conditions. For these purposes, the amount of release agent for the fixing member 5*b* is preferably set equal or less than 5.0 μl/A4 size. Especially, to prevent with certainty the oil ghost phenomenon under stringent conditions, the amount of release agent for the fixing member 5*a* is preferably set equal or less than 2.5 μl/A4 size.

The amounts of release agent for the fixing members 5*a* and 5*b* of the fuser 5 are set in this way. That is, as control is provided by the interlocking control means 9, if the second and following sheets 4 pass through the fuser 5, so-called oil ghost phenomenon should be prevented under normal use conditions. Therefore, the total amount of release agent for the fixing members 5*a* and 5*b* is preferably set equal or less than 8.0 μl/A4 size. Especially, to avoid the oil ghost phenomenon with certainty under stringent conditions, the total amount of release agent for the fixing members 5*a* and 5*b* is preferably set equal or less than 4.0 μl/A4 size.

Prior techniques close to the invention of the present application are disclosed in Japanese Patent Laid-Open Nos. 234606/1996 and 271134/1995, which are supplementarily described below.

In the former prior art reference, there is described a technique for preventing toner from transferring to both heating and pressure rolls (fixing rolls). For this purpose, the interlocking relation between the heating roll and the pressure roll is made different between when an image is transferred to one side of a transfer paper (sheet) and when images are transferred to both surfaces. Where the images on both sides of the sheet are fixed, a release agent is applied to the pressure roll until the transfer paper reaches the fuser.

In the latter prior art reference, there is described a technique for solving various technical problems, such as winding of sheet around the pressure fixing roll of the fuser means, production of nonuniform gloss on the first image on the pressure member side of a recording member, and peeling. Where two-sided printing is done, the amount of release agent on the pressure member on the fuser means is increased only when an image is created on the second surface of the recording member.

It may be said that these prior art techniques have the common concept as the invention of the present application in that the interlocking relation between both fixing rolls (heating fixing roll and pressure fixing roll) is varied.

In these prior art techniques, however, a release agent is applied to the side of the pressure roll at all times in the duplex mode to prevent offset of toner relative to the pressure fixing roll and winding of the sheet in the duplex mode. In the simplex mode, the interlocking relation between both fixing rolls is made different. In the duplex mode, the interlocking relation between both fixing rolls is set uniquely.

The present invention is intended to prevent image quality deterioration (so-called oil ghost phenomenon) caused by the fact that the release agent from the fuser is locally transferred to an intermediate transfer body. Forth is purpose, a release agent supply means 7 is fitted to at least a fixing member 5*a* located on the unfixed image-holding side of a sheet. Fixing members 5*a* and 5*b* are in contact with each other and roll over each other. To supply a release agent to the fixing members 5*a* and 5*b*, an interlocking mechanism 8 and an interlocking control means 9 are provided. The interlocking member 8 interlocks the fixing members 5*a*, 5*b* and the release agent supply means 7 with each other. The interlocking control means 9 controls the interlocking time of the interlocking mechanism 8 according to the length of the path of the sheet 4 going to the nip between the fixing members 5*a* and 5*b* where the duplex mode is selected. For instance, in the full-color mode in which the path of the sheet 4 is longer, the interlocking time of the interlocking mechanism 8 is set shorter.

In this way, these prior art references make no mention of the technical problem addressed by the present invention. Furthermore, these prior art references do not suggest any technical means (i.e., the interlocking time of the interlocking mechanism 8 is controlled according to conditions under which the sheet is transported in the duplex mode) capable of solving the technical problem.

Hence, the prior art techniques and the invention of the present application differ entirely in technical object and approach.

The operation of the novel technical means of the present invention is now described. In FIG. 1, the fuser 5 in accordance with the present invention is fitted to a two-sided imager that fixes images on both surfaces of a sheet 4 one by one in the duplex mode.

The fixing members 5*a* and 5*b* of the fuser 5 are in contact with each other and roll over each other. These fixing members 5*a* and 5*b* cooperate to nip and transport the sheet 4 and fix unfixed images on the sheet 4.

The release agent supply means 7 is mounted to at least the fixing member 5*a* located on the unfixed image-holding surface of the sheet 4. The supply means 7 supplies a constant amount of release agent to the fixing member 5*a*. The interlocking member 8 interlocks the fixing members 5*a*, 5*b* and the release agent supply means 7 with each other.

The interlocking member 8 forces the fixing members 5*a* and 5*b* to contact with each other and to roll over each other. The interlocking member 8 supplies a release agent to the fixing members 5*a* and 5*b*.

In the full-color mode, the length of the path of the sheet 4 going to the nip between the fixing members 5*a* and 5*b* is greater than a maximum tolerable length. Under this condition, if the duplex mode is selected, the interlocking control means 9 controls the interlocking time of the interlocking mechanism 8 shorter than in a tolerable mode corresponding to the maximum tolerable length. In this manner, the interlocking time of the interlocking mechanism 8 is controlled according to the length of the path of the sheet 4 going to the nip between the fixing members 5*a* and 5*b*.

Other objects and features of the invention will appear in the course of the description thereof, which follows.

DESCRIPTION OF THE PREFERRED EMBODIMENTS

The preferred embodiments of the present invention are hereinafter described by referring to the accompanying drawings.

First Embodiment

Figure 1:
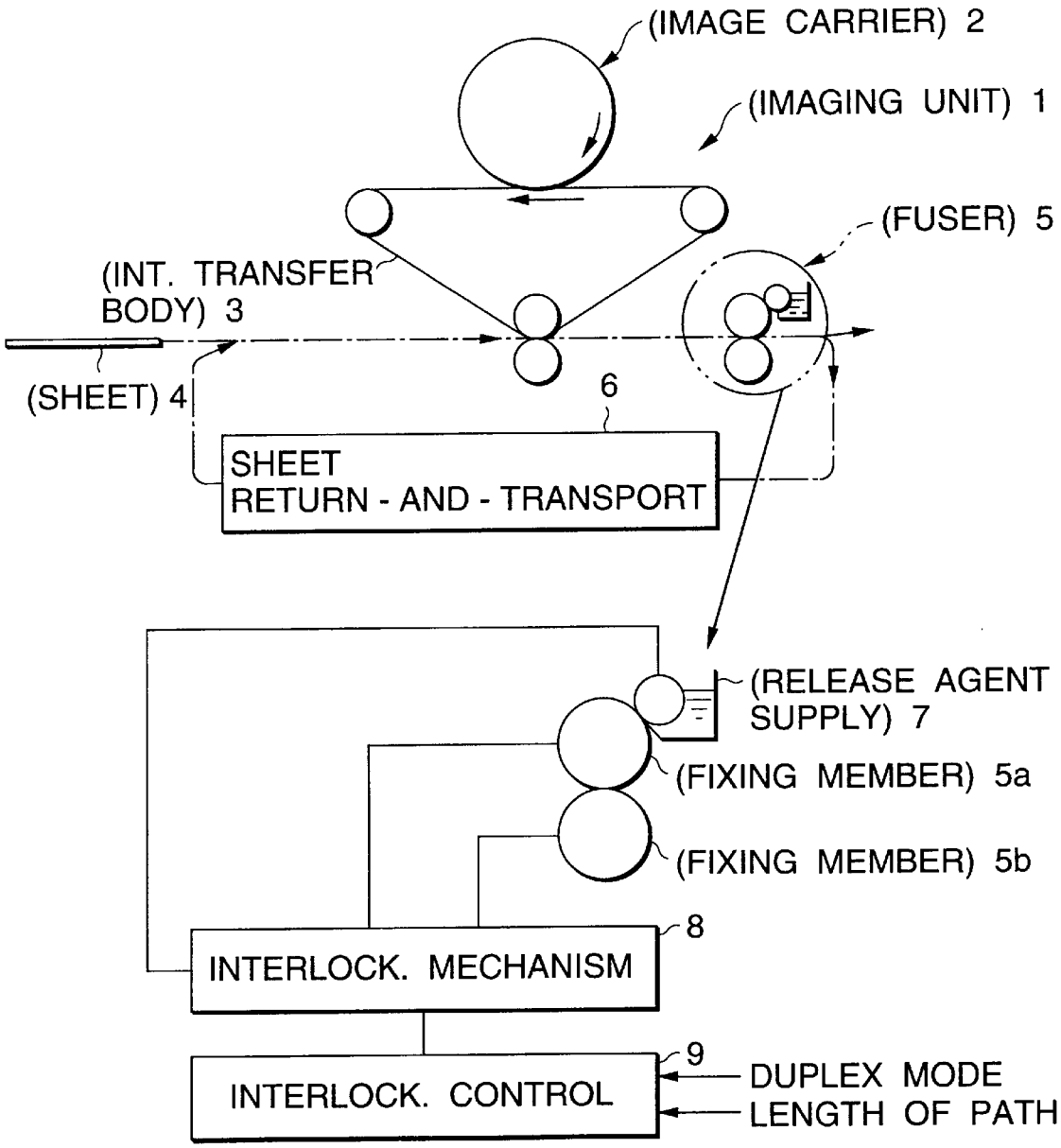
FIG. 1 is a schematic view of a fuser incorporated in a two-sided imager in accordance with the present invention.
Figure 2:
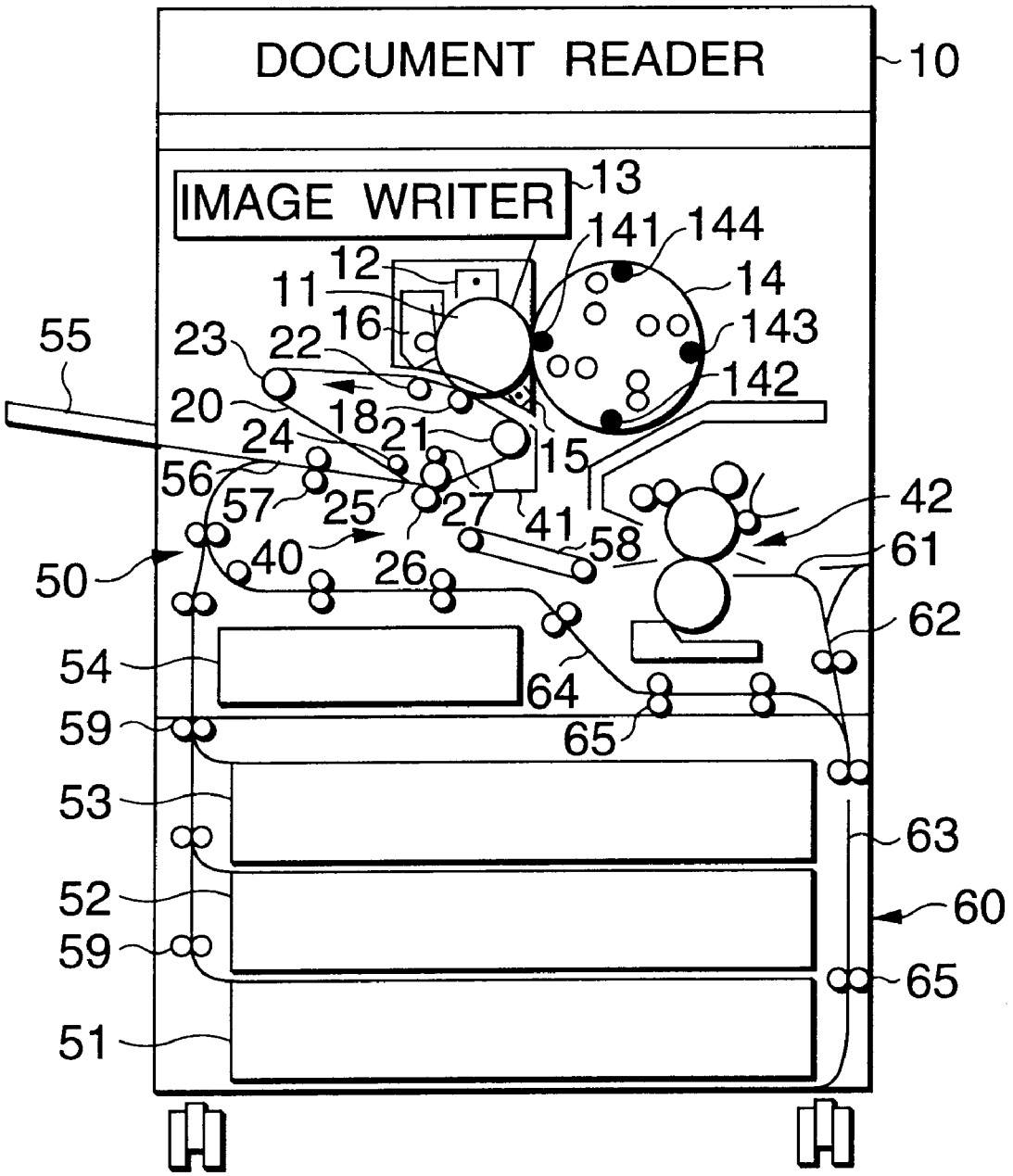
FIG. 2 is a schematic side elevation of a two-sided imager in accordance with a first embodiment of the invention.

FIG. 2 schematically shows a two-sided imager of the intermediate transfer type utilizing the present invention. In the present embodiment, this imager consists of a color electrophotographic copier.

In FIG. 2, a document reader 10 reads images of various color components, i.e., yellow (Y), magenta (M), cyan (C), and black (K). A photoconductor (PC) drum 11 is a latent image carrier rotates in the direction indicated by the arrow, for example. A charger 12 such as a corotron previously charges the drum 11. An image writer 13 consisting of a laser scanner, for example, writes document image from the document reader 10 or other image onto the drum 11 as an electrostatic latent image. A rotary development system 14 is fitted with developing units 141–144 corresponding to the various colors, or yellow (Y), magenta (M), cyan (C), and black (K). The latent image formed on the drum 11 is developed by any of the developing units 141–144 and form toner images of the various color components. A pre-transfer processor 15 consists of a corotron, for example, and acts to make uniform the polarities of the toner images of the various color components on the PC drum 11. A drum cleaner 16 removes toner remaining on the PC drum 11.

An intermediate transfer belt 20 is mounted to abut against the surface of the PC drum 11, and is trained across plural rolls 21–25 (in the present embodiment, five rolls) and rotates in the direction indicated by the arrow.

In this embodiment, the driving roll 21 drives the intermediate transfer belt 20. The rolls 22 and 24 are follower rolls. The roll 23 is a tension roll for regulating the tension on the intermediate transfer belt 20. The roll 25 is a counter roll (back-up roll) for secondary transfer.

In the present embodiment, the intermediate transfer belt 20 is made of a resin such as polyimide, polycarbonate, polyester, polypropylene, or polyethylene terephthalate or various kinds of rubber to which an appropriate amount of carbon black or the like is added such that the surface resistivity becomes $10^6$ to $10^{14}$ Ω/L. The thickness is set to 0.1 mm, for example.

At the position of the intermediate transfer belt 20 (the primary transfer location) opposite to the PC drum 11, a primary transfer device (in the present embodiment, a transfer roll) 18 is mounted behind the intermediate transfer belt 20. A voltage of polarity opposite to the charge on the toner is applied to the transfer roll 18. As a result, the toner image on the PC drum 11 is electrostatically attracted to the intermediate transfer belt 20.

The intermediate transfer belt 20 has the secondary transfer position opposite to the path along which paper (not shown) in the form of a sheet is transported. A secondary transfer device 40 is mounted in this secondary transfer position. In the present embodiment, the secondary transfer device 40 comprises a secondary transfer roll 26 and a counter roll (back-up roll) 25. The secondary transfer roll 26 is pressed against the toner image-holding side of the intermediate transfer belt 20. The counter roll 25 is disposed on the rear side of the intermediate transfer belt 20 and services as a opposite electrode to the secondary transfer roll 26.

In the present embodiment, the secondary transfer roll 26 is grounded. A bias voltage having the same polarity as the electric charge on the toner is stably applied to the back-up roll 25 via a feeding roll 27. A belt cleaner 41 removes the toner remaining on the intermediate transfer belt 20.

In the present embodiment, a paper transport system 50 transports paper from a given number of paper trays 51–54 (four paper trays in the present embodiment) or from a manual tray 55 along a given paper path 56. The paper is once halted at a registration roll 57 located in the path 56. Then, the transport system 50 sends the paper to the secondary transfer position at given timing. The paper undergone the secondary transfer is guided to a conveyor belt 58, which in turn sends the paper to the fuser 42. The paper path 56 is fitted with an appropriate number of pairs of conveyor rolls 59.

In this embodiment, there is provided a paper return-and-transport mechanism 60 which, where the duplex mode is selected, reverses the paper whose one side has been fixed by the fuser 42 and returns the paper to secondary transfer position.

This paper return-and-transport mechanism 60 has a paper branching path 62 branching downward from a paper output path 61 from the fuser 42, as shown in FIG. 2. A paper reversing path 63 extends downward from the paper branching path 62. A paper return path 64 runs from the paper reversing path 63 to the paper path 56 in front of the secondary transfer position.

An appropriate number of pairs of conveyor rolls 65 are mounted in the paper branching path 62, paper reversing path 63, and paper return path 64. The conveyor rolls 65 mounted in the paper reversing path 63 reverse at appropriate timing.

Paper selector gates (not shown) are mounted between the paper output path 61 and the paper branching path 62 and among the paper branching path 62, the paper reversing path 63, and the paper return path 64. The paper path is appropriately switched according to the selected mode.

Figure 3:
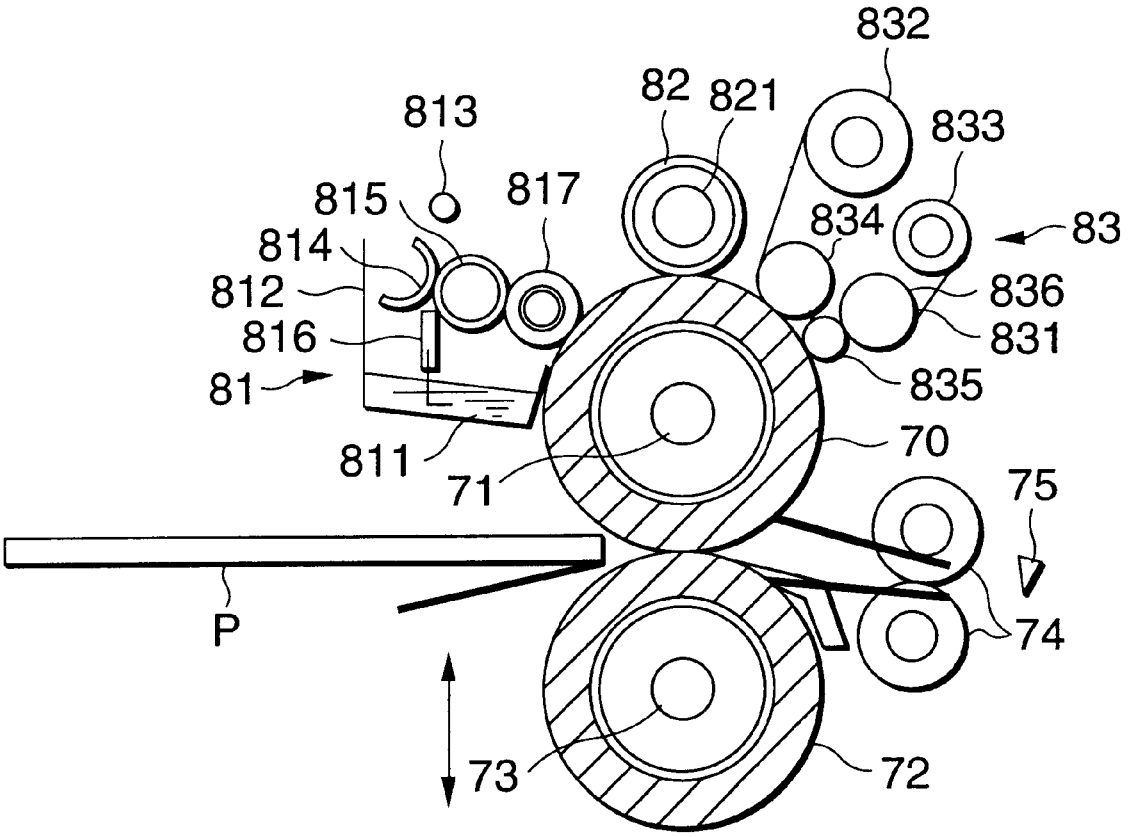
FIG. 3 is a side elevation of a fuser used in the first embodiment of the invention.

In the present embodiment, the fuser 42 is equipped with a heating fixing roll 70 and a pressure fixing roll 72 pressed against the heating roll 70 in the nip, as shown in FIG. 3. The heating roll 70 incorporates a heater 71. The pressure roll 72 rolls over the heating roll 70 and incorporates a heater 73. A pair of output rolls 74 is mounted at the exit of the nip formed by both fixing rolls 70 and 72. An output sensor 75 is mounted immediately behind the output rolls 74 to detect passage of paper P.

In this embodiment, each of the heating roll 70 and pressure roll 72 consists of a hollow roller having a given outside diameter of $\phi$65 mm, for example. This hollow roller has an aluminum hollow core having a thickness of 4.5 mm, for example. A base layer as made of silicone rubber or the like is formed on the roll core of each roll. For instance, a base layer having a thickness of 3 mm is formed on the heating roll 70. A base layer having a thickness of 2 mm is formed on the pressure roll 72. A surface layer made of Viton® fluoroelastomer, for example, is formed on the surface of each base layer.

An oil supply device 81, an external heating roll 82, and a web cleaner 83 are located in this order upstream of the nip formed by both fixing rolls 70 and 72 around the heating roll 70.

In the present embodiment, the oil supply device 81 has an oil pan 812 containing oil (such as an amine-modified silicone oil as described later) 811 acting as a toner release agent. The oil 811 is sent from the oil pan 812 to a wick 814 via an oil pipe 813 such that the wick 814 is impregnated with the oil. A pick-up oil 815 is in contact with the wick 814. A metal blade 816 for limiting the amount of oil on the surface of the pick-up oil 815 is kept in contact with the pick-up roll 815. A donor roll 817 is interposed between the pick-up roll 815 and the heating roll 70. Oil is supplied at a constant rate to the heating roll 70 via the donor roll 817.

One example of the toner release agent used in the present embodiment includes functional groups and containing at least organopolysiloxane as an active ingredient, the organopolysiloxane being given by (I)

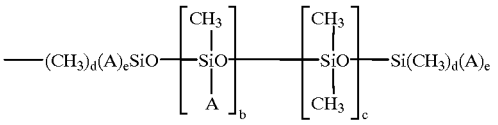

where A is $—R^1—X$ or $—R^1—O—Yf—H$ (where $R^1$ is analkylene group having 1 to 8 carbons, X is $—NH_2$ or $—NHR^2NH_2$ (where $R^2$ is alkylene group having 1 to 8 carbons), Y is an alkylene group having 2 to 4 carbons, and f is an integer of 0 to 10), b and c satisfy the relations $0 \leqq b \leqq 10$ and $10 \leqq c \leqq 1{,}000$ and do not assume 0 simultaneously, d is 2 or 3, e is 0 or 1, and d and e satisfy the relation d+e=3. The viscosity of the release agent at 25° C. is 10 to 100,000 cs.

The external heating roll 82 incorporates a heater 821 and is made of a metal (e.g., a stainless-based material that can effectively prevent corrosion or an Alumite-processed metal) having lower release property than the heating roll 70. This external heating roll 82 can be brought into and out of contact with the heating roll 70. For example, at warm-up, the heating roll 82 touches the heating roll 70 to enhance its surface heating efficiency.

The web cleaner 83 comprises a web 831 that can be wound and has a small amount of fibrous components. The cleaner 83 supplies the web 831 from one web supply roll 832 and recovers the web 831 by other web recovery roll 833.

In this embodiment, the web cleaner 83 has a first pressure roll 834 behind the web 831 corresponding to the heating fixing roll 70. This first pressure roll 834 presses the web 831 against the heating roll 70 with a given nip width. A cleaning roll 835 is mounted between the heating roll 70 and the outer surface of the web 831. A second pressure roll 836 is mounted behind the web 831 corresponding to the cleaning roll 835. This second pressure roll 836 presses the cleaning roll 835 against the heating roll 70 with a given nip width.

In the present embodiment, the intermediate transfer belt 20 has an image carrier area (not shown) corresponding to A3 size, for example. A reference mark 91 for generating a reference signal is formed in a part of the region other than the image carrier area of the intermediate transfer belt 20. A mark sensor 92 is positioned in a given location spaced from the intermediate transfer belt 20, corresponding to the trajectory of the moving reference mark 91.

For example, a light reflector of high reflectivity or a hole passing light is used as the reference mark 91. An optical sensor or any other sensor may be selected as the mark sensor 92 as long as it can detect the reference mark 91.

Figure 4:
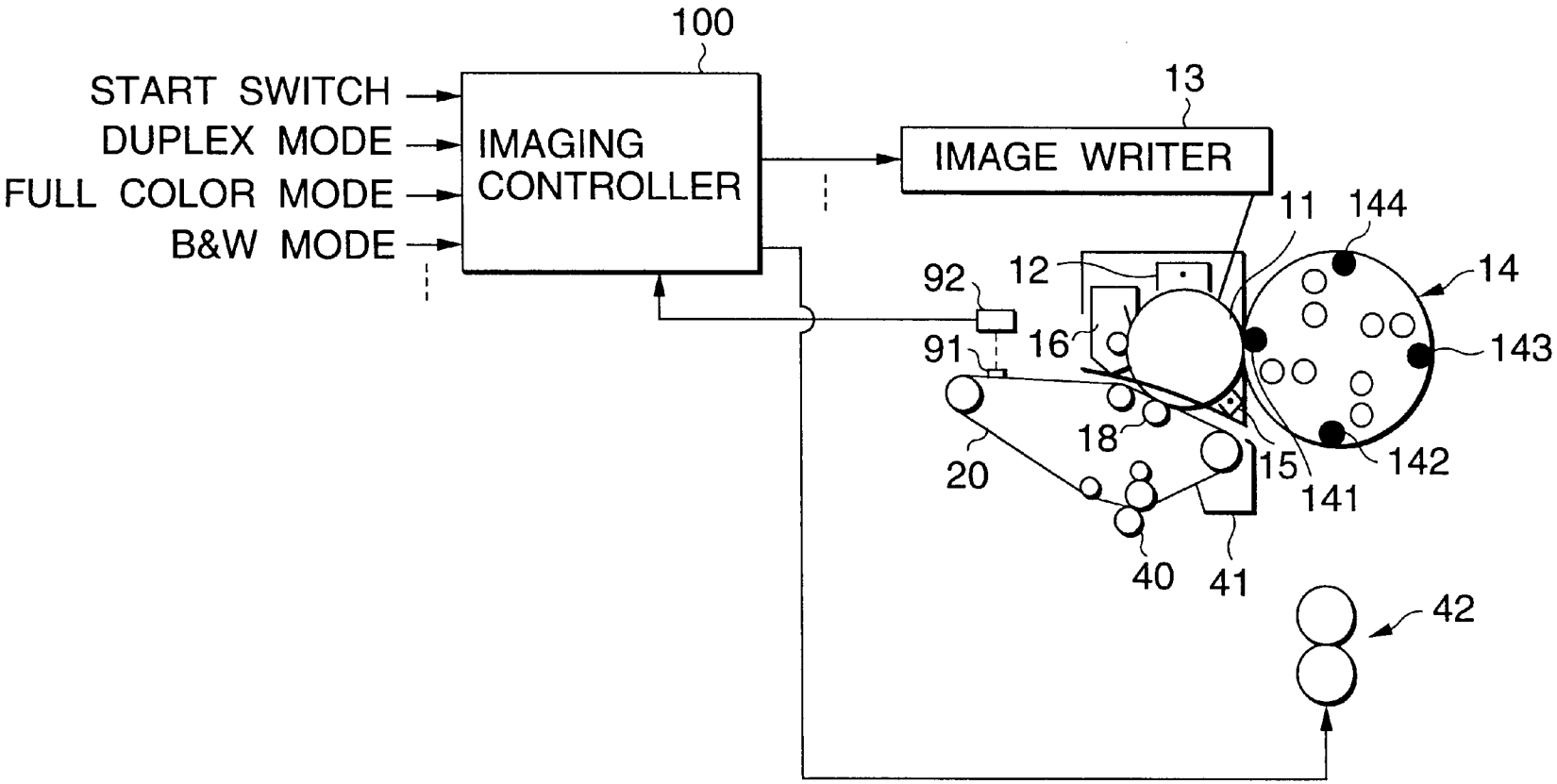
FIG. 4 is a block diagram of an imaging control system used in the first embodiment of the invention.

In the present embodiment, an imaging controller 100 consists of a microcomputer system, for example, having a CPU, a ROM, a RAM, and I/O ports. As shown in FIG. 4, signals from various mode selector switches such as a start switch, a duplex mode selector switch, a full-color mode selector switch, and a black-and-white (B & W) mode selector switch and the output signal from the mark sensor 92 are accepted into the CPU via the I/O ports. The CPU executes an imaging processing program previously loaded in the ROM, and sends given control signals to the photoconductor (PC) drum 11, the image writers 13, other imaging devices, the intermediate transfer belt 20, the fuser 42, the paper transport system 50, and so on via the I/O ports.

Figure 5:
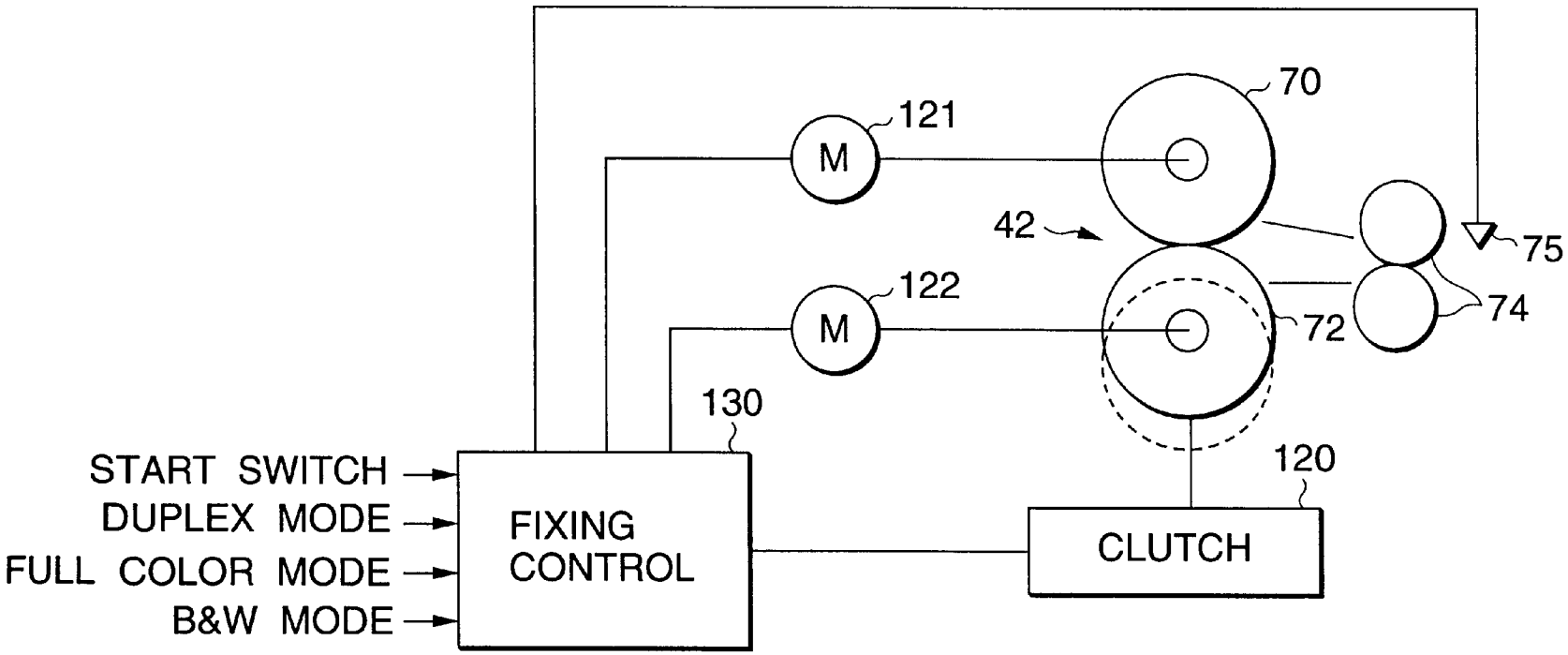
FIG. 5 is a block diagram of a fixing control system included in the imaging control system shown in FIG. 4.

The present embodiment is characterized in that the pressure fixing roll 72 of the fuser 42 is held by a clutch 120 so as to be movable back and forth, as shown in FIG. 5. The pressure roll 72 comes into and out of contact with the heating roll 70 at appropriate timing.

The fixing rolls 70 and 72 are driven by driving motors 121 and 122, respectively.

Figure 6:
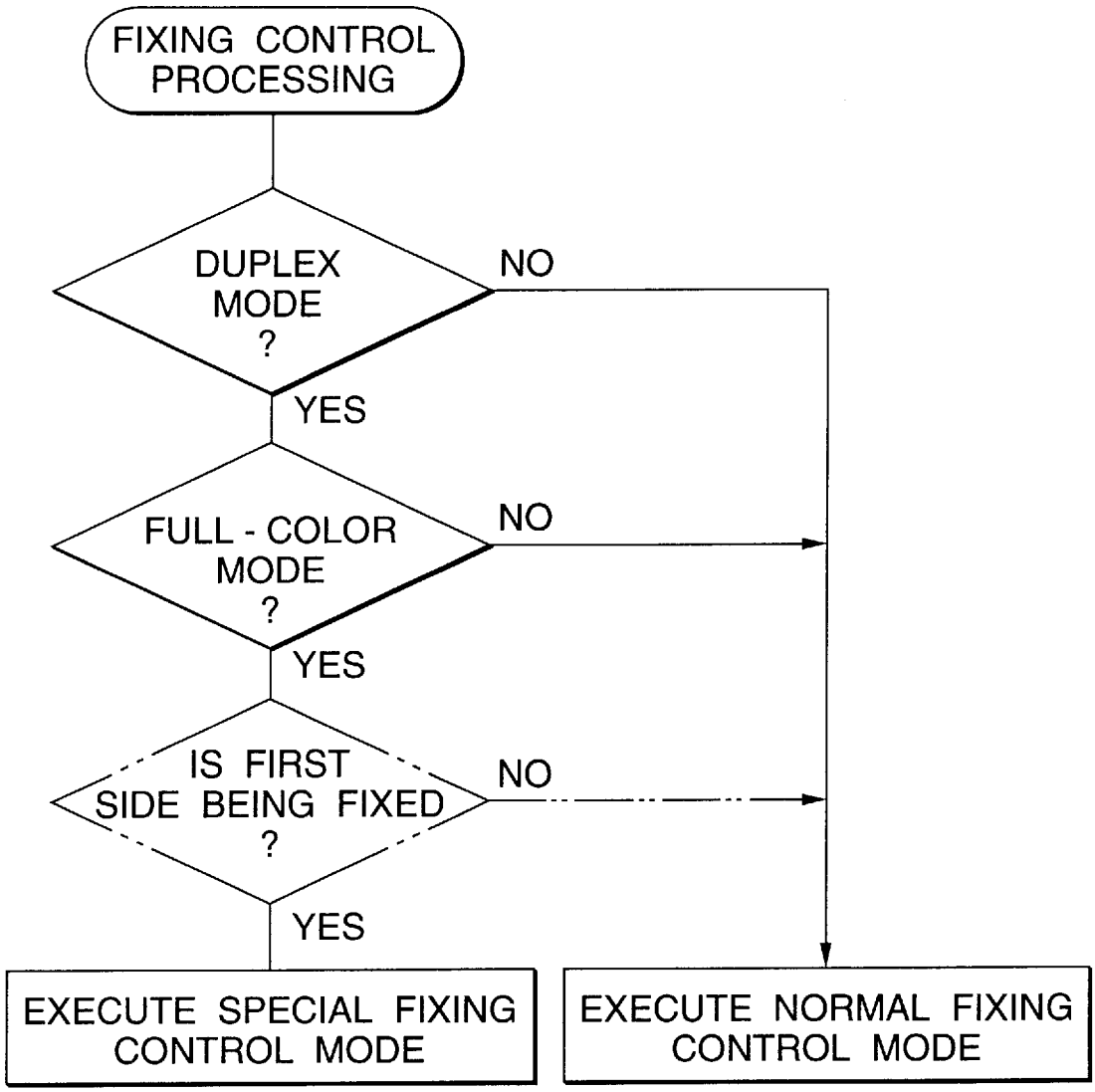
FIG. 6 is a flowchart illustrating fixing control processing performed in the first embodiment of the invention.

In the present embodiment, the imaging controller 100 is provided with a fixing control portion 130 for controlling the fuser 42. This fixing control portion 130 executes a fixing control processing program as illustrated in FIG. 6 according to signals from the start switch and various mode selector switches and according to the signal from the output sensor 75 of the fuser 42, and sends given control signals to the clutch 120, the driving motors 121, 122, and so on. The temperatures of the heaters 71, 73 in the fixing rolls 70 and 72, respectively, and of the heater 821 of the external heating roll 82 are controlled in a manner not illustrated in FIG. 5.

The two-sided imager of the intermediate transfer type in accordance with the present invention creates images by a process described below in the duplex mode.

Full-Color Mode

If the user selects the full-color mode in the auto duplex mode, the imaging controller 100 creates images by a full-color imaging sequence. In particular, a first imaging cycle is carried out. The intermediate transfer belt 20 makes its first through fourth revolutions. Whenever the intermediate transfer belt 20 makes one revolution, the imaging controller 100 transfers images S-1(Y), S-1(M), S-1(C), and S-1(K) of various color components (i.e., yellow, magenta, cyan, and black) of a first-side image S-1 of the first sheet to the image carrier region of the intermediate transfer belt 20 according to a belt reference signal (the detective signal from the mark sensor 92).

When the intermediate transfer belt 20 makes 4 revolutions, the first-side image S-1 (i.e., the composite transfer image of the images of the various color components) is held on the image carrier region of the intermediate transfer belt 20 and transferred to the first surface (front surface) of the first sheet. The transferred sheet is fixed by the fuser 42 and then transported back into the secondary transfer position via the paper return-and-transport mechanism 60.

In the second imaging cycle, the intermediate transfer belt makes its fifth through eighth revolutions. Whenever the transfer belt 20 makes one revolution, the imaging controller 100 transfers images D-1 (Y), D-1 (M), D-1 (C), and D-1 (K) of color components of yellow, magenta, cyan, and black of the second-side image D-1 of the first sheet to the image carrier region on the intermediate transfer belt 20 according to the belt reference signal.

On completion of the four revolutions of the intermediate transfer belt 20, the second-side image D-1 (the composite transfer image of the various color components) of the first sheet is held on the image carrier area on the intermediate transfer belt 20. The image on the intermediate belt 20 is transferred to the second side, or the rear surface, of the first sheet in the secondary transfer position. The transferred sheet is fixed by the fuser 42. The sheet whose both sides have been fixed is moved through the paper output path 61 and discharged to the output tray (not shown) as it is.

In the following imaging cycles, the ith first-side image S-i and the ith second-side image D-i are transferred to the intermediate transfer belt 10. These images are then transferred to the first side (front surface) and the second side (rear surface), respectively, of the ith sheet in the secondary transfer position. Then, the transferred sheet is fixed by the fuser 42.

In this imaging process, if the full-color mode is selected in the duplex mode as illustrated in FIG. 6, the fixing control portion 130 executes a special fixing control mode.

Figure 7:
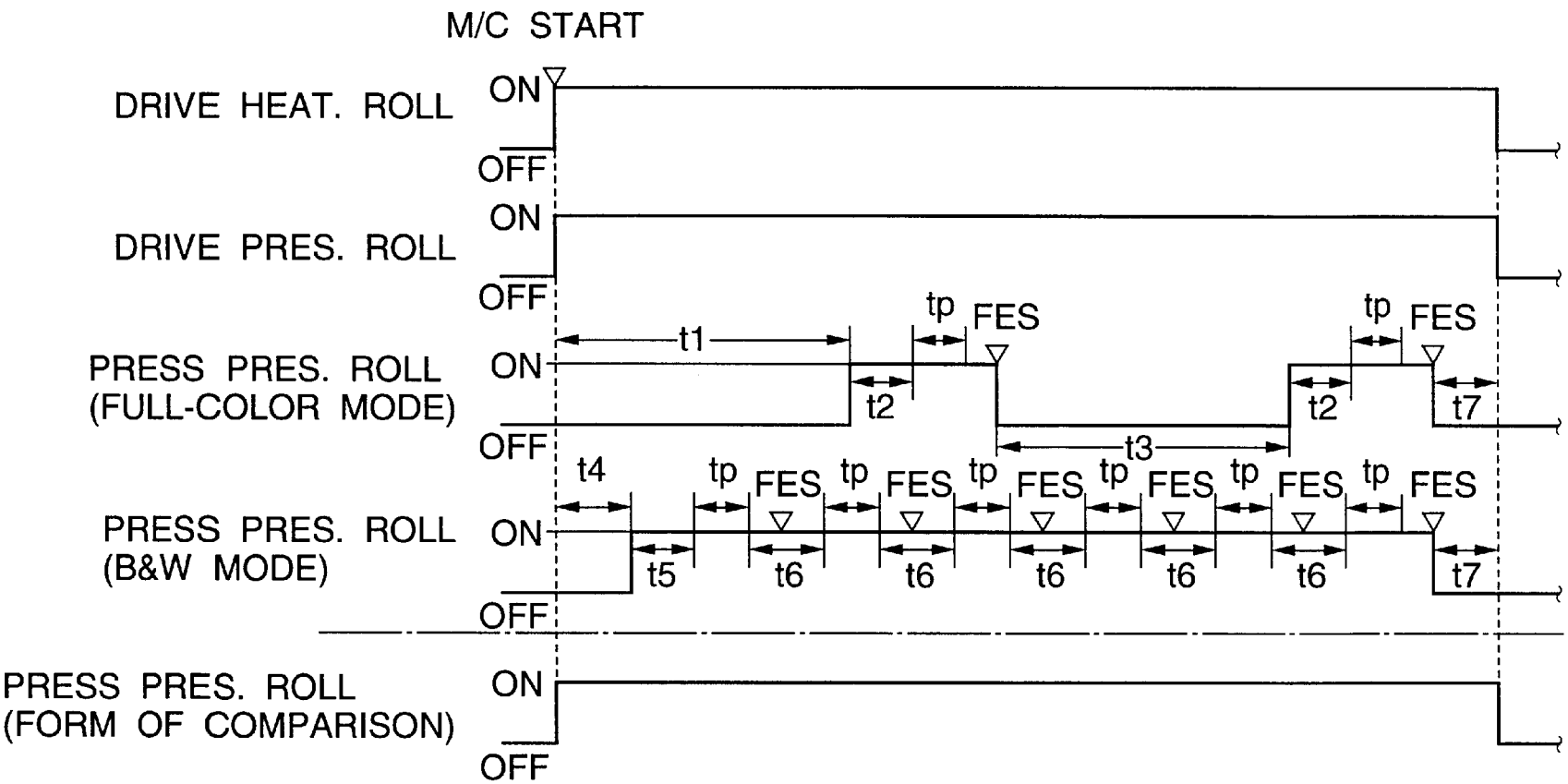
FIG. 7 is a timing chart illustrating in the fixing control processing performed in the first embodiment of the invention.

In the present embodiment, the special fixing control mode is performed as illustrated in FIG. 7. The heating fixing roll 70 and the pressure fixing roll 72 are previously driven by the driving motors 121 and 122 in response to start of the machine (M/C). After at least one revolution of the heating roll 70, when a given time of t1 (e.g., 10 sec in the present embodiment) has passed, the clutch 120 brings the pressure roll 72 into contact with the heating roll 70, thus nipping the sheet. When a given time of t2 (e.g., 2 sec in the present embodiment) has passed while both rolls 70 and 72 are kept in contact with each other, the sheet is passed through the nip between the rolls 70 and 72 in a given time of tp. The clutch 120 disengages the rolls 70 and 72 from each other according to the output (FES) from the output sensor 75 that detects passage of the sheet through the nip. After a lapse of a given time t3 (e.g., 10 sec in the present embodiment), the clutch 120 again engages the fixing rolls 70 and 72. These operations are subsequently repeated.

In this embodiment, the final paper undergone the given job passes through the nip between both rolls 70 and 72. Then, if the output (FES) from the output sensor 75 is detected, both rolls 70 and 72 are deactivated after a lapse of a given time of t7.

In this special fixing control mode, timing (t1–t3) limiting the interlocking time of the fixing rolls 70 and 72 (in the embodiment, the time of driving the fixing rolls 70, 72 in contract with each other) is determined, taking account of the imaging process time sufficient for the imaging cycle for creating a full-color image to rotate the intermediate transfer belt 20 four times, and in order to supply an amount of release agent to the pressure roll 72, the amount of release agent being necessary to prevent so-called oil ghost and nonuniform melting of the fixed image.

Black and White (B & W) Mode

If the auto duplex mode is selected in the Black & White mode, the imaging controller 100 creates images in the black-and-white imaging sequence.

In the first imaging cycle, the imaging controller 100 transfers the first image-side image S1 of the first paper (image S-1(K) of black component) to the image carrier region of the intermediate transfer belt 20 according to the belt reference signal (the detective signal from the mark sensor 92) during the first revolution of the intermediate transfer belt 20.

On completion of the first revolution of the intermediate transfer belt 20, the first-side image S-1 (S-1(K)) of the first sheet is held on the image carrier region of the intermediate transfer belt 20 and transferred to the first side (front surface) of the first sheet. The transferred paper is fixed by the fuser 42. Then, the paper is transported back into the secondary transfer position via the paper return-and-transport mechanism 60.

In this embodiment, a dummy cycle is carried out while the paper whose one side has been fixed is being transported back into the secondary transfer position via the paper return-and-transport mechanism 60. That is, the intermediate transfer belt 20 rotates idly.

In the next second imaging cycle, the imaging controller 100 transfers second-side image D-1 (image D-1(K) of black component) of the first sheet to the image carrier region on the intermediate transfer belt 20 at appropriate timing based on a timer (not shown) without using the belt reference signal.

In the present embodiment, images of the various color components need to be registered accurately on the intermediate transfer belt 20 and transferred in the full-color mode. Therefore, whenever the intermediate belt 20 makes a revolution, the belt reference signal is used. In the black-and-white mode, images of the various color components are not required to be registered before being transferred in the full-color mode. Therefore, the belt reference signal is used only at the beginning. After the second imaging cycle, timing is done based on the timer or the like without using the belt reference signal.

On completion of one revolution of the intermediate transfer belt 20, the second-side image D-1 (D-1(K)) of the first sheet is held on the image carrier region on the intermediate transfer belt 20 and transferred to the corresponding surface of the paper. The transferred paper is fixed by the fuser 42. Then, the paper whose both sides have been fixed is discharged to the output tray (not shown) via the paper output path 61.

In the following imaging cycles, the first-side image S-i of the ith sheet and the second-side image D-i of the ith sheet are transferred to the intermediate transfer belt 10. These images are transferred to the first surface (front surface) and the second surface (rear surface), respectively, of the ith sheet. Subsequently, the paper having the transferred images is fixed by the fuser 42.

In the present embodiment, while the paper having one side fixed is being returned to the secondary transfer position via the paper return-and-transport mechanism 60, the intermediate transfer belt 20 under goes dummy cycles. Note that the invention is not limited to this method. Where higher speed should be achieved, imaging cycles may be performed while treating two adjacent sheets as a unit without effecting dummy cycles. That is, the first-side image on the first sheet and the first-side image on the next sheet are treated. Then, the second-side image on the first sheet and the second-side image on the next sheet are treated.

In this imaging process, the fixing control portion 130 executes normal fixing control mode if duplex mode and black-and-white mode are selected, as illustrated in FIG. 6.

In the normal fixing control mode in accordance with the present embodiment, the heating fixing roll 70 and the pressure fixing roll 72 are previously driven by the driving motors 121 and 122 in accordance with start of the machine (M/C), as illustrated in FIG. 7. After at least one revolution of the heating roll 70 and after a lapse of a given time of t4 (e.g., 2.5 sec), the clutch 120 brings the pressure roll 72 into contact with the heating roll 70, thus nipping the sheet. After a lapse of a given time of t5 (e.g., 2 sec in the present embodiment) while both rolls 70 and 72 are kept in contact with each other, the paper is passed through the nip between both rolls 70 and 72 in a given time of tp. Subsequently, sheets are passed through at regular intervals of t6 (e.g., 2.5 sec). The interlocking state between both rolls 70 and 72 is maintained until an output (FES) from the output sensor 75 is detected after the final sheet has passed through the nip.

In this embodiment, if the output (FES) from the output sensor 75 is detected after the final sheet has passed through the nip between both rolls 70 and 72, these rolls 70 and 72 are deactivated after a lapse of a given time of t7, in the same way as in the full-color mode.

In the embodiment described thus far, the timing at which the pressure roll 72 is brought into contact with the heating roll after start of the machine (M/C) is made different from the timing in the full-color mode. The invention is not limited to this scheme. Rather, any appropriate method may be selected.

Oil Supply Conditions for Fuser

In the present embodiment, the following oil supply conditions are established for the fuser 42 in performing the aforementioned imaging process.

The test was conducted under the following method.

The fuser 42 used in the present embodiment was first tested for its fundamental performance.

The pressure roll 72 was brought into contact with the heating roll 70 of the fuser 42. Ten idle rotations were made.

A continuous sheet consisting of 4 sheets of A3 size joined together in two layers was passed through the fuser 42. The oil rates at the fixing rolls 70 and 72, respectively, were measured. The results are given in FIG. 8.

The fuser 42 used for the tests was designed to rotate twice within the length of the sheet of A3 size in the longitudinal direction. During the test, oil was supplied to the heating roll 70 from the oil supply device 81. However, no oil was supplied to the pressure roll 72, because there is no gap between this roll and the paper.

Figure 8:
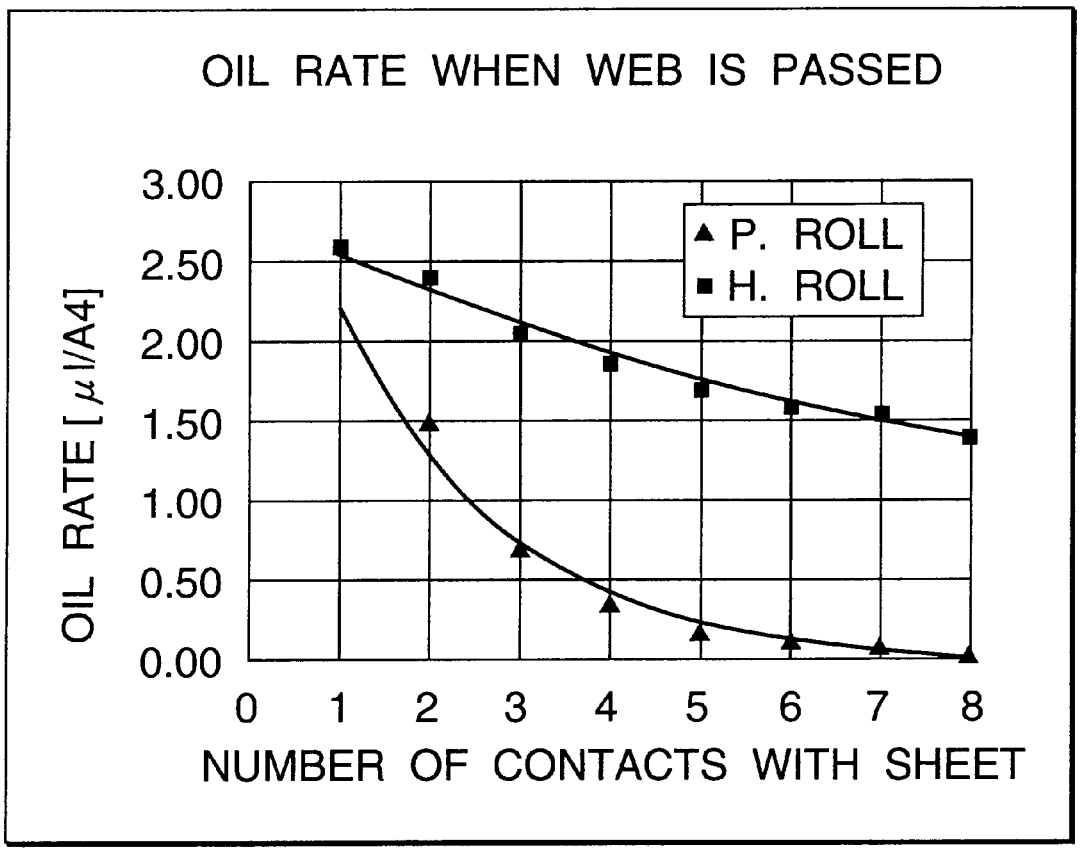
FIG. 8 is a graph illustrating oil rate variations when a web passes through the fuser used in the first embodiment of the invention.

FIG. 8 indicates that when the number of contacts with the paper reached 8, the oil rate at the heating roll 70 decreased down to about 1 $\mu$l/A4 size and that the oil rate at the pressure roll 72 was almost null.

The variations in the oil rate when continuous paper, or web, was passed were measured until the number of contacts reached 8. Idle rotations were made while maintaining the heating roll 70 and the pressure roll 72 in contact with each other. The variations in the amount of oil applied from the heating roll 70 to the pressure roll were measured. The results are given in FIG. 9.

Figure 9:
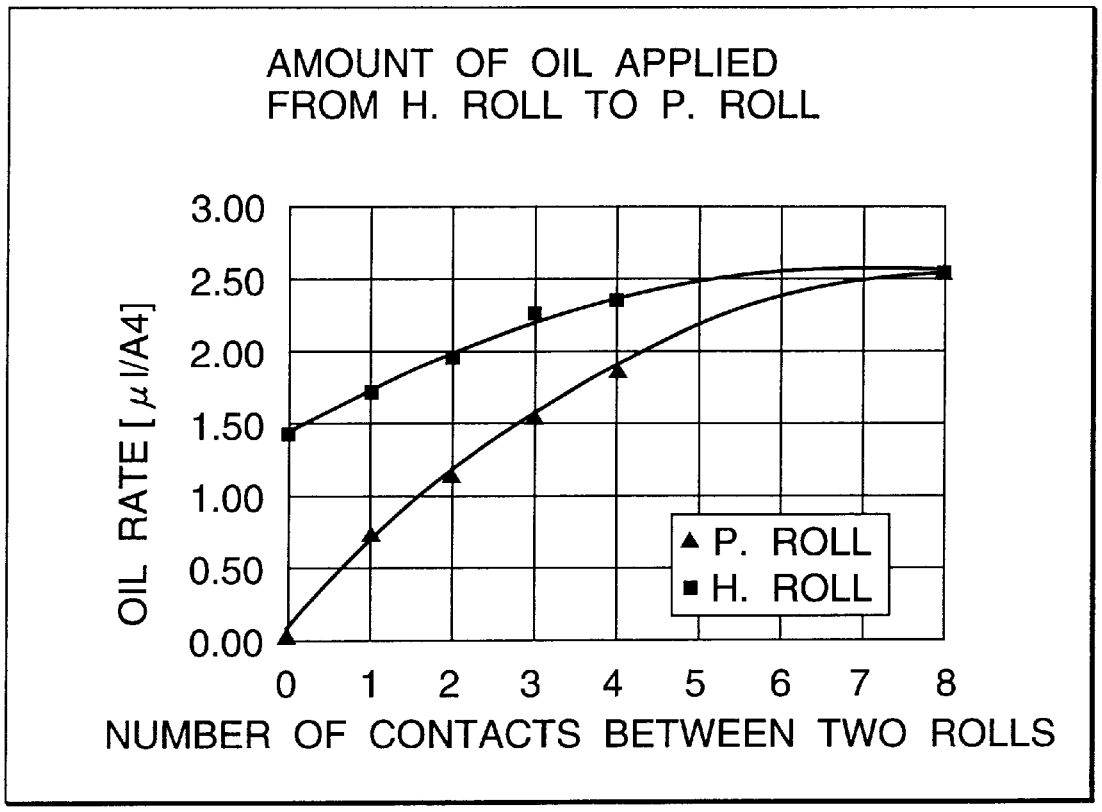
FIG. 9 is a graph illustrating variations in the amount of oil applied from a heating fixing roll to a pressure fixing roll in the fuser used in the first embodiment of the invention.

FIG. 9 reveals that when the number of contacts between both rolls 70 and 72 reached 8, the oil rate at the pressure roll 72 that was almost null came back to the initial oil rate (e.g., 2.6 $\mu$l/A4 size) at the heating roll 70.

In the present embodiment, the relation between the number of prints and variations in the oil rates at the fixing rolls 70 and 72 of the fuser 42 was examined for a case in which duplex mode and full-color mode were selected and for a case in which duplex mode and black-and-white mode were selected. The results are given in FIG. 10.

Figure 10:
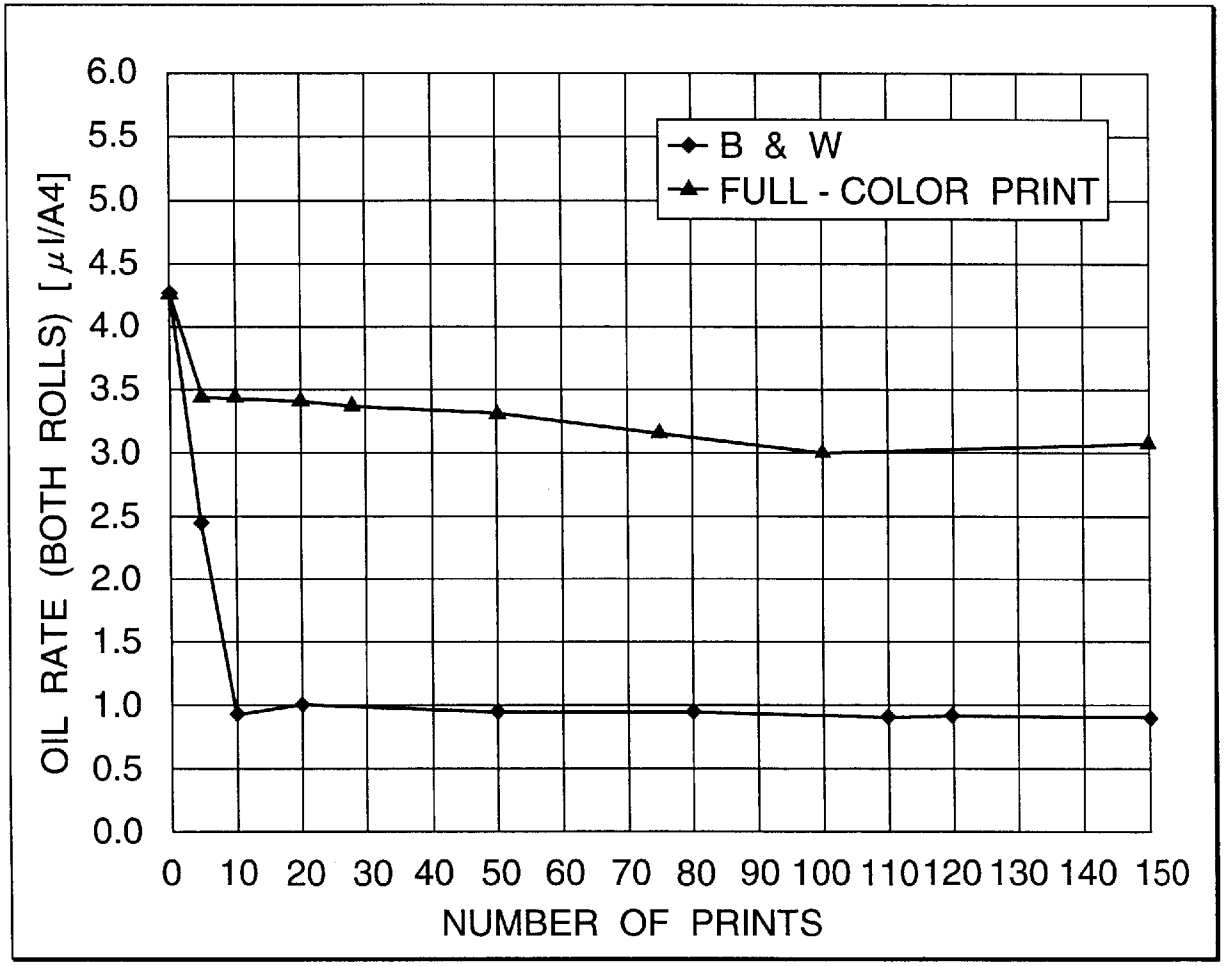
FIG. 10 is a graph in which the oil rate at the heating fixing roll and the pressure fixing roll in the fuser used in the first embodiment of the invention is plotted against the number of prints for plural print modes.

It can be seen from FIG. 10 that the fixing controller portion 130 controlled the interlocking time between the fixing rolls 70 and 72 in the full-color mode. The oil rate at both rolls 70 and 72 was suppressed below 3.5 $\mu$l/A4 size after the fifth sheet.

On the other hand, in the black-and-white mode, the fixing controller portion 130 maintained the interlocking relation between the fixing rolls 70 and 72, but the oil rate at both rolls 70 and 72 was suppressed below 1.0 $\mu$l/A4 size after 10th sheet. It can be seen that the oil rate is prevented from rising steeply.

If the oil rate at the pressure roll 72 when the first-side image is fixed is excessive, so-called oil ghost phenomenon may take place.

Accordingly, the machine was run continuously in the auto duplex mode. The relations among the number of prints, the oil amount difference (K cps/30 mm in diameter) on the intermediate transfer belt, and the density difference ($\Delta$D) were examined. The results are given in FIG. 11.

Tests were conducted under the following conditions. The sum of the oil rate at the heating roll 70 and the oil rate at the pressure roll 72 was set to 8 $\mu$l/A4 size. A mode in which 100 sheets of the same contents are passed is referred to herein as the-stringent mode. Six kinds of documents (e.g., 14 sets of documents) having an average area coverage of 20% were prepared. Each of these documents is passed repeatedly three times. This mode is referred to herein as the normal use mode. In this graph, the straight line indicated by the dotted line approximates oil amount differences on the intermediate transfer belt in the stringent mode and in the normal use mode. The straight line indicated by the solid line approximates density differences in both modes.

Figure 11:
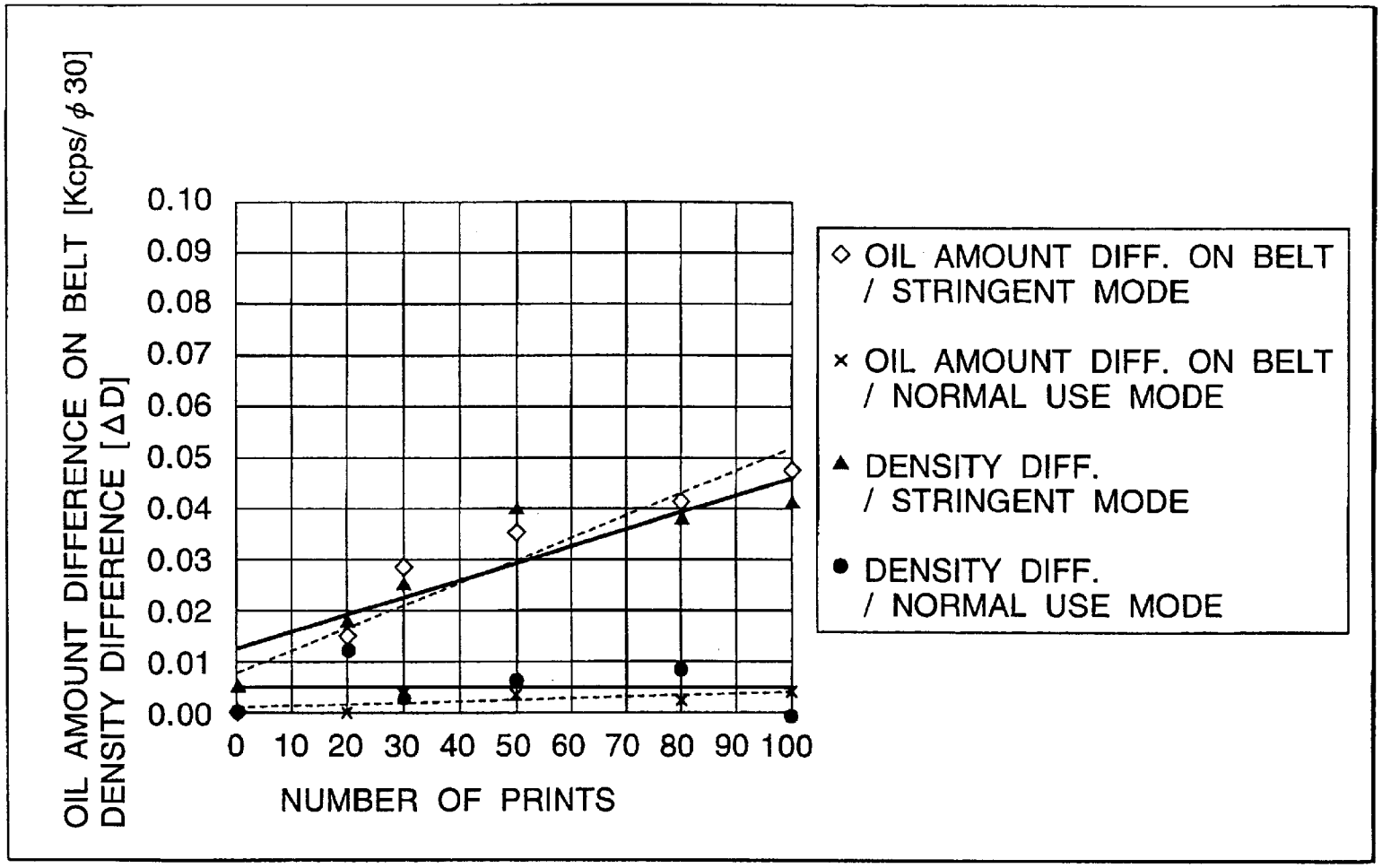
FIG. 11 is a graph illustrating the relation between the number of prints and oil amount difference on an intermediate transfer belt in the fuser used in the first embodiment of the invention, as well as the relation between the number of prints and density dfference (oil ghost)

FIG. 11 shows that a visually observable oil ghost (white dropouts) appeared at density differences greater than 0.03.

In the normal use mode, the oil amount difference and the density difference varied only a little. No oil ghost appeared. In the stringent mode, the density difference became equal or greater than 0.03 when the number of prints exceeded about 50, and oil ghost was observed.

Under these conditions, in the stringent mode the oil rate at the pressure roll 72, the oil amount difference (K cps/30 mm in diameter) on the intermediate transfer belt, and the density difference (ΔD) were examined. The results are given in FIG. 12.

Figure 12:
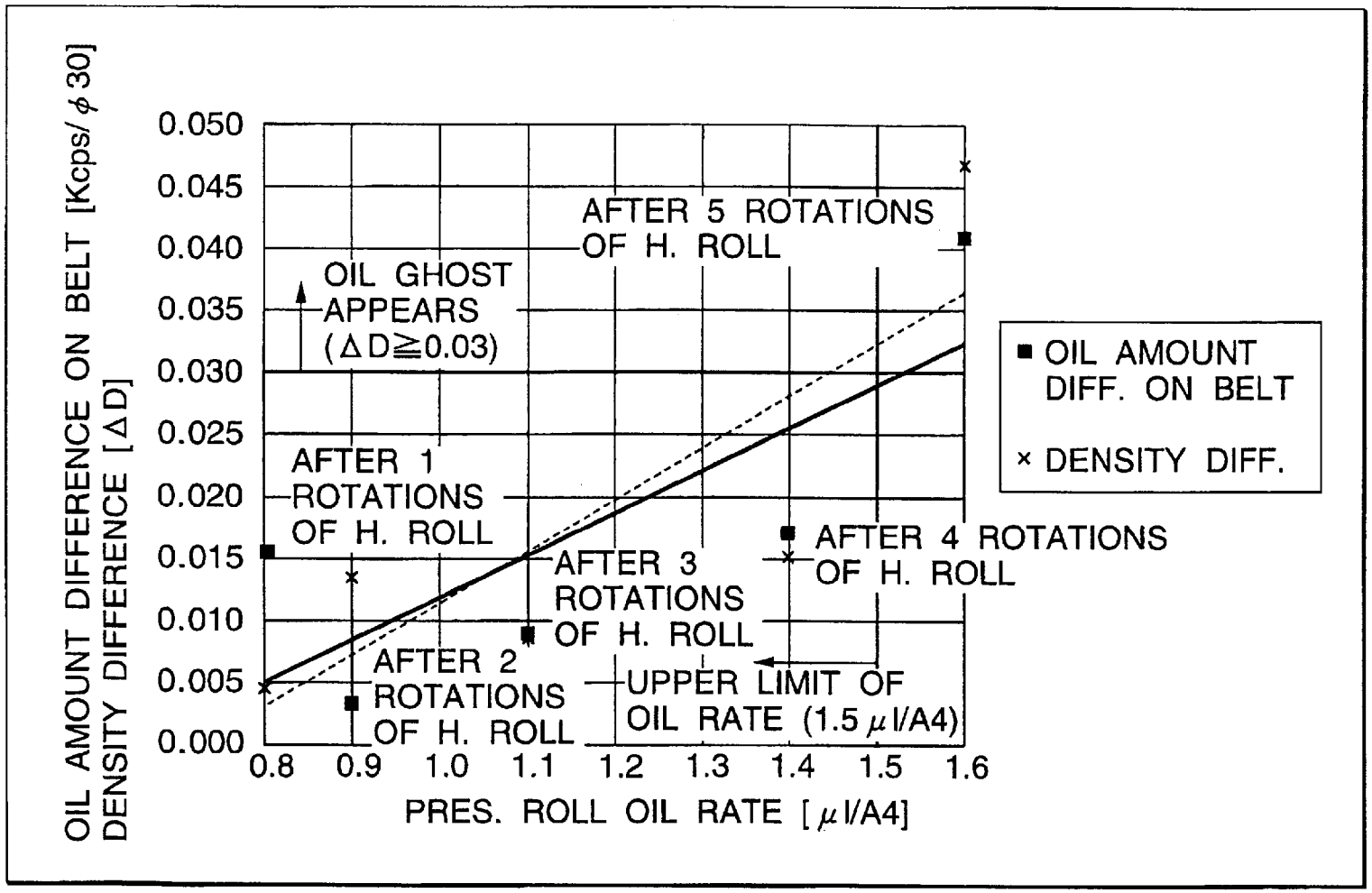
FIG. 12 is a graph showing the relation between the oil rate at the pressure fixing roll in the fuser used in the first embodiment and the oil amount difference on the intermediate transfer belt under stringent conditions, as well as the relation between the number of prints and density difference (oil ghost)

In FIG. 12, "after k (k=1 to 5) rotations of the heating roll" means that the heating roll 70 has made k revolutions while both rolls 72 and 70 are in contact with each other, nipping the paper. The line indicated by the dotted line approximates the oil amount difference on the intermediate transfer belt. On the other hand, the straight line indicated by the solid line approximates density differences.

It can be seen from FIG. 12 that the density difference became equal or more than 0.03 when the oil rate at the pressure roll 72 exceeded 1.5 μl/A4 size. Therefore, to prevent oil ghost in the stringent mode, the oil rate at the pressure roll 72 must be equal or less than 1.5 μl/A4 size.

In the normal use mode, if the oil rate at the pressure roll 72 was equal or less than 3.0 μl/A4 size, no oil ghost was observed at all.

In the special fixing control processing in accordance with the present embodiment, the oil rate at the pressure roll 72 is adjusted to about 1.2 μl/A4 size. Therefore, even in the stringent mode, there is no danger of occurrence of the aforementioned oil ghost.

On the other hand, in comparative example of the fixing control processing as illustrated in FIG. 7, both rolls 70 and 72 are driven at the start of the machine (M/C). At the same time, they are brought into contact with each other, nipping the paper. Subsequently, the interlocking relation between both rolls 70 and 72 is maintained. In this comparative fixing control processing, the oil rate at the pressure rate 72 is about 2.6 μl/A4 size. Therefore, there is a danger of oil ghost occurring in the stringent mode.

When the second side, or the rear surface, is fixed, the first-side image on the paper already fixed is brought into contact with the pressure roll 72.

At this time, if the amount of oil acting as a release agent at the side of the pressure oil 72 is small, there is the danger that the paper is wound around the pressure roll 72 or the fixed image is offset.

Accordingly, the amount of oil to the paper carrying a fixed image (in particular, the oil rate at the pressure roll 72) was varied. The size of the paper was A3 in this example. The temperature of the pressure roll 72 producing nonuniform melting in the fixed image was examined. The results are given in FIG. 13.

Figure 13:
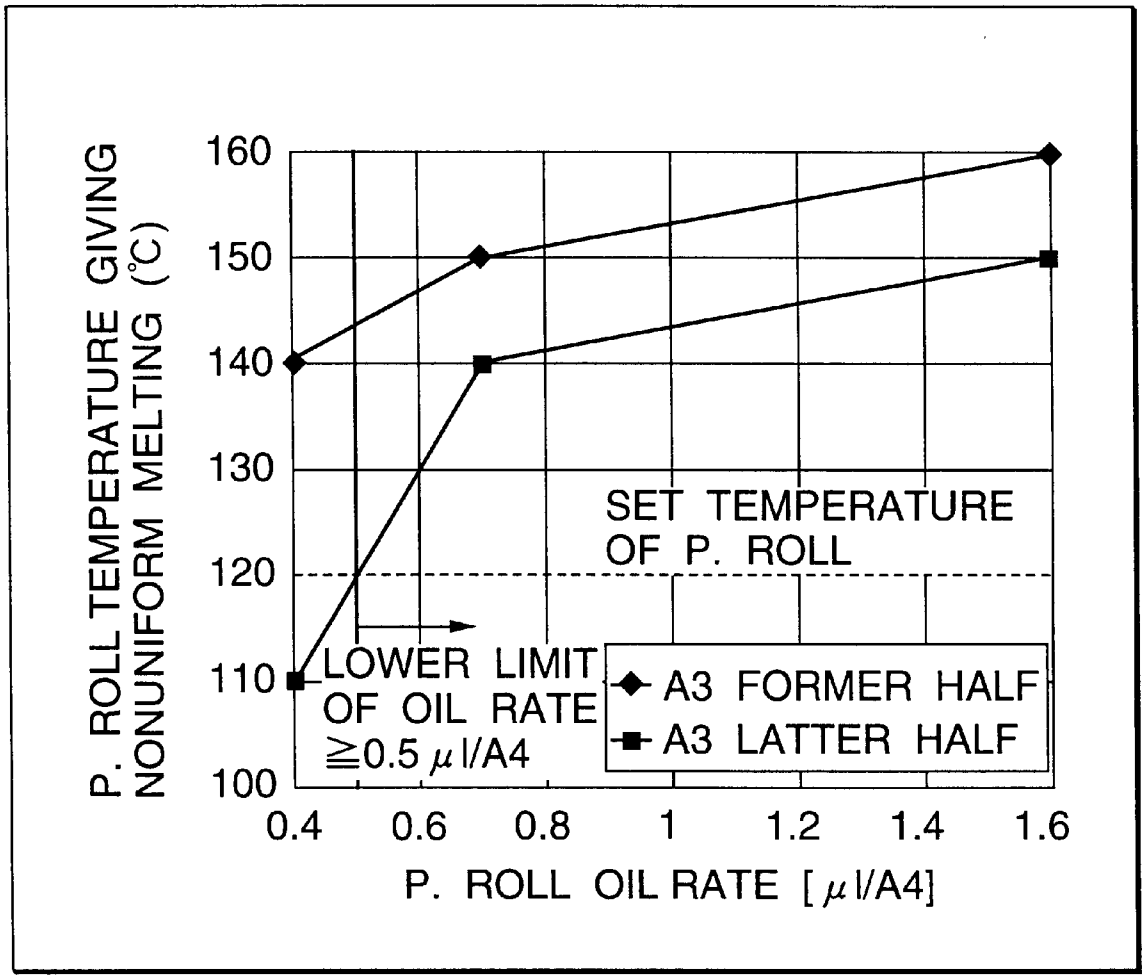
FIG. 13 is a graph illustrating the relation between the oil rate at the pressure fixing roll in the fuser used in the first embodiment of the invention and the temperature at which the pressure fixing roll produces nonuniform melting.

It can be seen from FIG. 13 that if the set temperature of the pressure roll 72 is 120° C., for example, the lower limit of the oil rate at the pressure roll 72 is preferably equal or more than 0.5 μl/A4 size. In view of the fact that the variations in the set temperature of the pressure roll 72 is about 20° C., the oil rate at the pressure roll 72 should be equal or more than 0.7 μl/A4 size.

Figure 14:
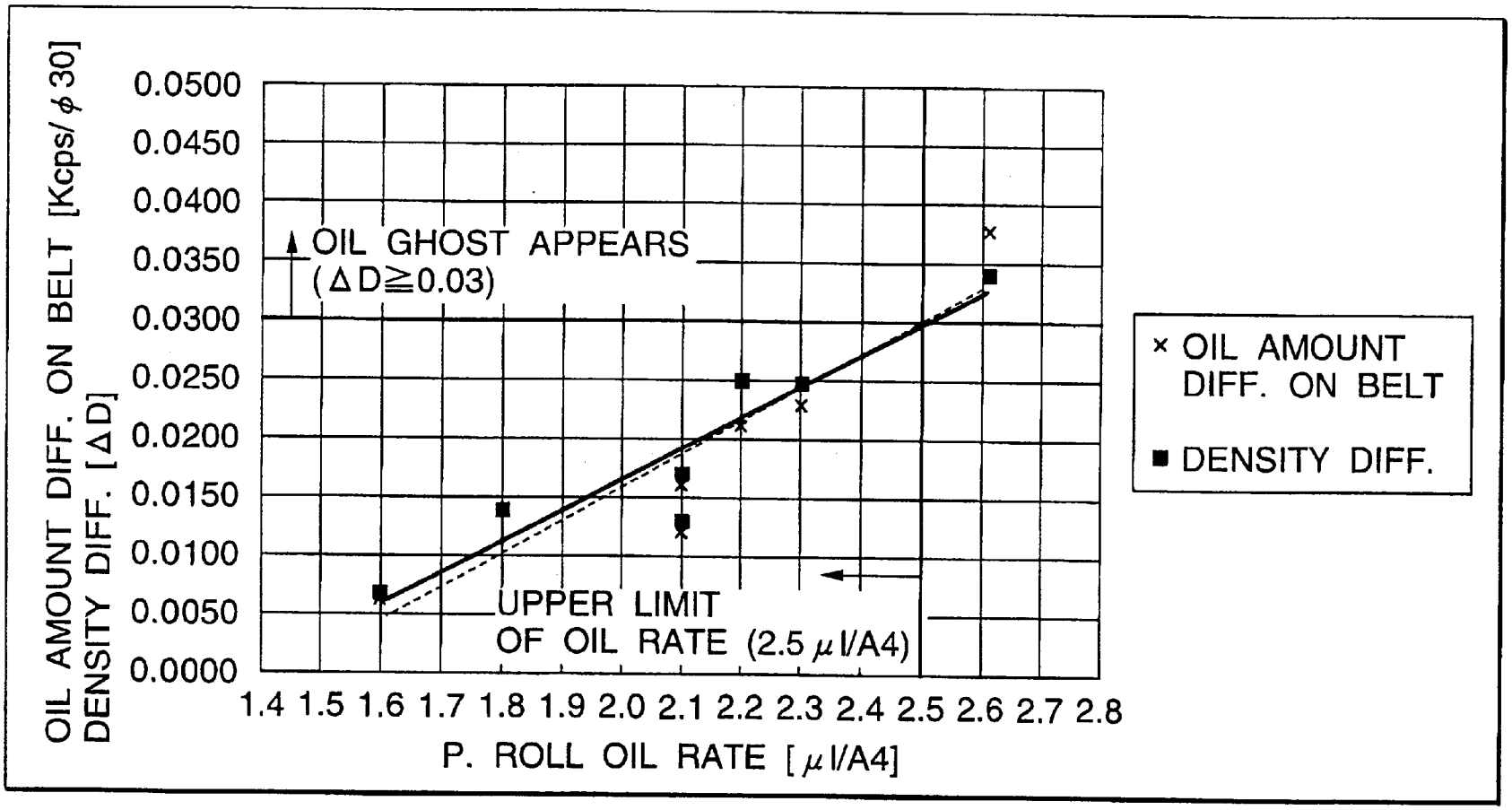
FIG. 14 is a graph showing the relation between the oil rate at the heating fixing roll in the fuser used in the first embodiment and the oil amount difference on the intermediate transfer belt under stringent conditions, as well as the relation between the number of prints and density difference (oil ghost)

In the present embodiment, the relations among the oil rate at the heating roll 70, the oil amount difference on the intermediate transfer belt (K cps/30 mm in diameter), and the density difference ΔD were examined. The results are given in FIG. 14.

In this figure, the straight line indicated by the dotted line approximates the oil amount difference on the intermediate transfer belt. The straight line indicated by the solid line approximates density differences.

It can be seen from this figure that the density difference was equal or 0.03 when the oil rate at the heating roll 70 exceeded 2.5 μl/A4 size. Consequently, it can be understood that oil ghost can be prevented in the stringent mode by setting the oil rate at the heating roll 70 to equal or less than 2.5 μl/A4 size.

It was confirmed that no oil ghost was observed at all where the oil rate at the heating roll 70 was equal or less than 5.0 μl/A4 size.

Therefore, where full-color mode is selected in the duplex mode, at least it is necessary to make an adjustment to prevent supply of an excess amount of oil to the rear surface of the sheet during fixing of the first-side image. This will prevent nonuniform melting and oil ghost.

The special fixing control processing is adopted where full-color mode is selected in the duplex mode. In this control processing, the oil rate at the pressure roll 72 is set to less than about 3.0 μl/A4 size, preferably 0.7 to 1.5 μl/A4 size. The oil rate at the heating roll 70 is set to less than about 5.0 μl/A4 size, preferably less than 2.5 μl/A4 size.

It can be seen that the sum oil rate at both rolls 70 and 72 is less than about 8.0 μl/A4 size, preferably less than about 4.0 μl/A4 size.

In the present embodiment, if the full-color mode is selected in the duplex mode, the sum oil rate at both rolls 70 and 72 is set to equal or less than 4.0 μl/A4 size at the second and following sheets as illustrated in FIG. 10. Oil ghost or other inconveniences were not observed at all.

The details of the fuser 42 in accordance with the present invention may be modified.

Figure 15:
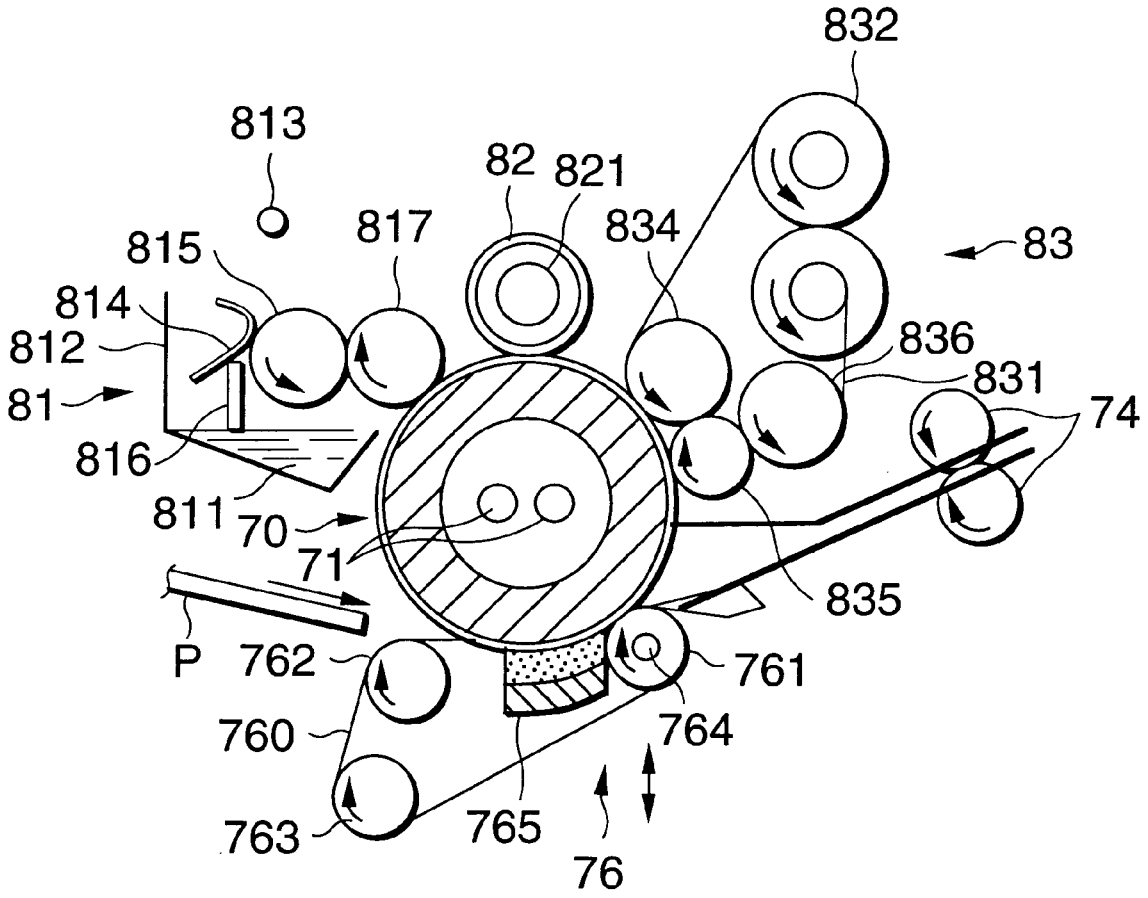
FIG. 15 is a side elevation of a modification of the fuser used in the first embodiment.

In this embodiment, the heating roll 70 and the pressure roll 72 are a pair of rolls opposite to each other. The invention is not limited to this structure. For example, as shown in FIG. 15, a pressure fixing belt 76 may be used instead of the pressure fixing roll 72. Note that like components are indicated by like reference numerals in various figures and that those components which have been already described in connection with FIG. 3 will not be described below.

The pressure fixing belt 76 comprises an endless belt 760 trained across plural sets of rolls 761–763. Any one of the rolls, e.g., the roll 763, is used as a driver roll. Any one of the rolls, e.g., the roll 761, has a heater 764 incorporated therein. An assist pad 765 is mounted behind the endless belt 760 opposite to the heating roll 70. The endless belt 760 is pressed against the assist pad 765.

With this belt-nipping method using such a pressure fixing belt 76, a wide nip can be secured for fixing. This stabilizes the fixing process. Furthermore, the warm-up time can be shortened because the heat capacity of the pressure fixing belt 76 is low.

In the present embodiment, where the full-color mode is selected in the duplex mode, it is customary to execute the special fixing control mode. The invention is not limited to this scheme. Oil ghost appears because an excess of oil at the side of the pressure roll 72 transfers to the rear surface of the paper during fixing of the first side image. Therefore, it is also possible to make a decision as to whether the process is the fixing of the first-side image as indicated by the phantom line in FIG. 6, if the full-color mode is selected in the duplex mode. The special fixing control mode may be carried out only in the fixing of the first-side image.

Second Embodiment

Figure 16:
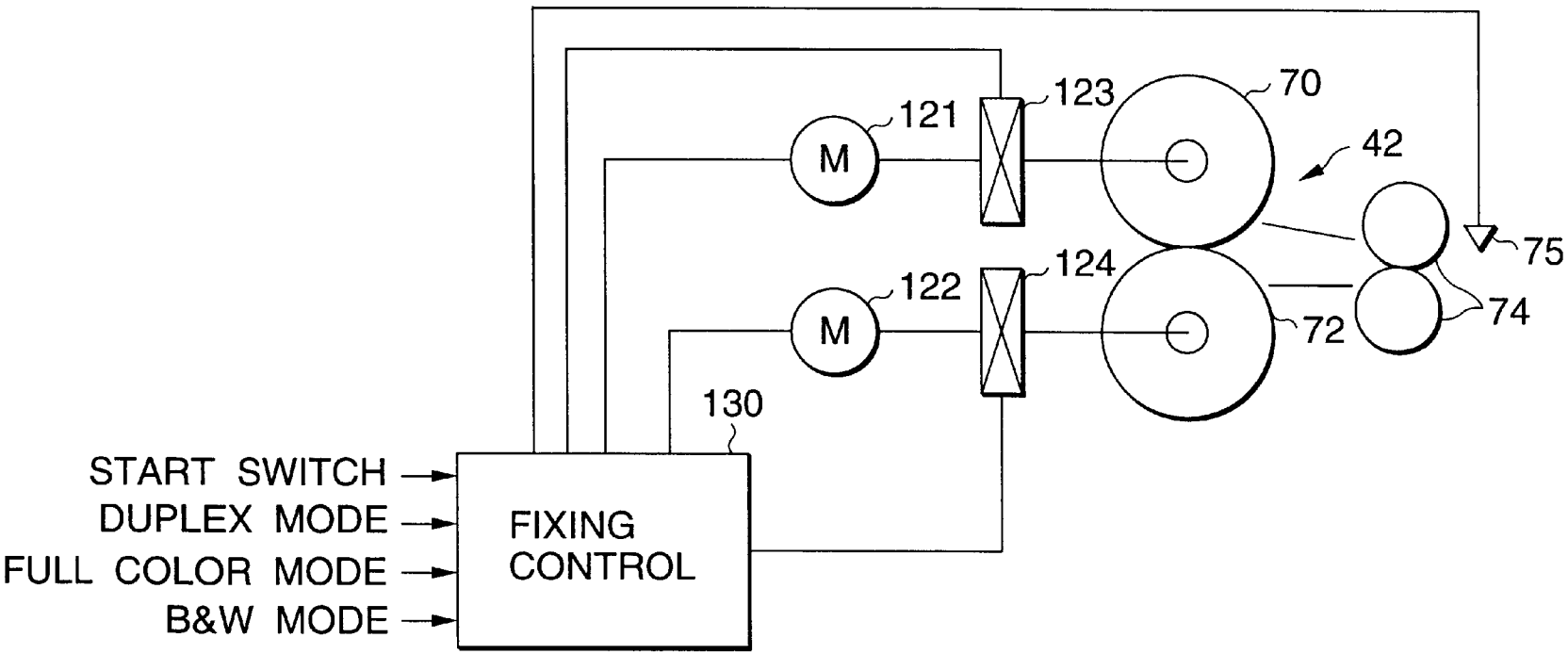
FIG. 16 is a schematic view illustrating a fixing control system used in a fuser in a two-sided imager in accordance with a second embodiment of the invention.

A second embodiment of the present invention is next described by referring to FIG. 16. This embodiment is a fuser in a two-sided imager.

The fuser, 42, differs from that in the first embodiment in that the heating roll 70 and the pressure roll 72 are kept in contact with each other at all times and that clutches 123 and 124 are interposed between the fixing rolls 70, 72 and the driving motors 121, 122, respectively, to connect and disconnect both rolls.

The fixing control portion 130 in accordance with the present embodiment executes the fixing control processing program illustrated in FIG. 6 according to signals from the start switch and from various mode selector switches and according to the output signal from the output sensor 75 in the fuser 42, and send given control signals to the driving motors 121, 122, the clutches 123, 124, and so on. The temperatures of the heaters 71, 73 in the fixing rolls 70 and 72, respectively, and of the heater 821 of the external heating roll 82 are controlled in a manner not illustrated in FIG. 16.

The fixing control processing for the fuser in accordance with the present embodiment is next described.

Where the full-color mode is selected in the duplex mode, the fixing control portion 130 carries out special fixing control processing. On the other hand, if the black-and-white mode is selected in the duplex mode, the normal fixing control processing is executed.

Figure 17:
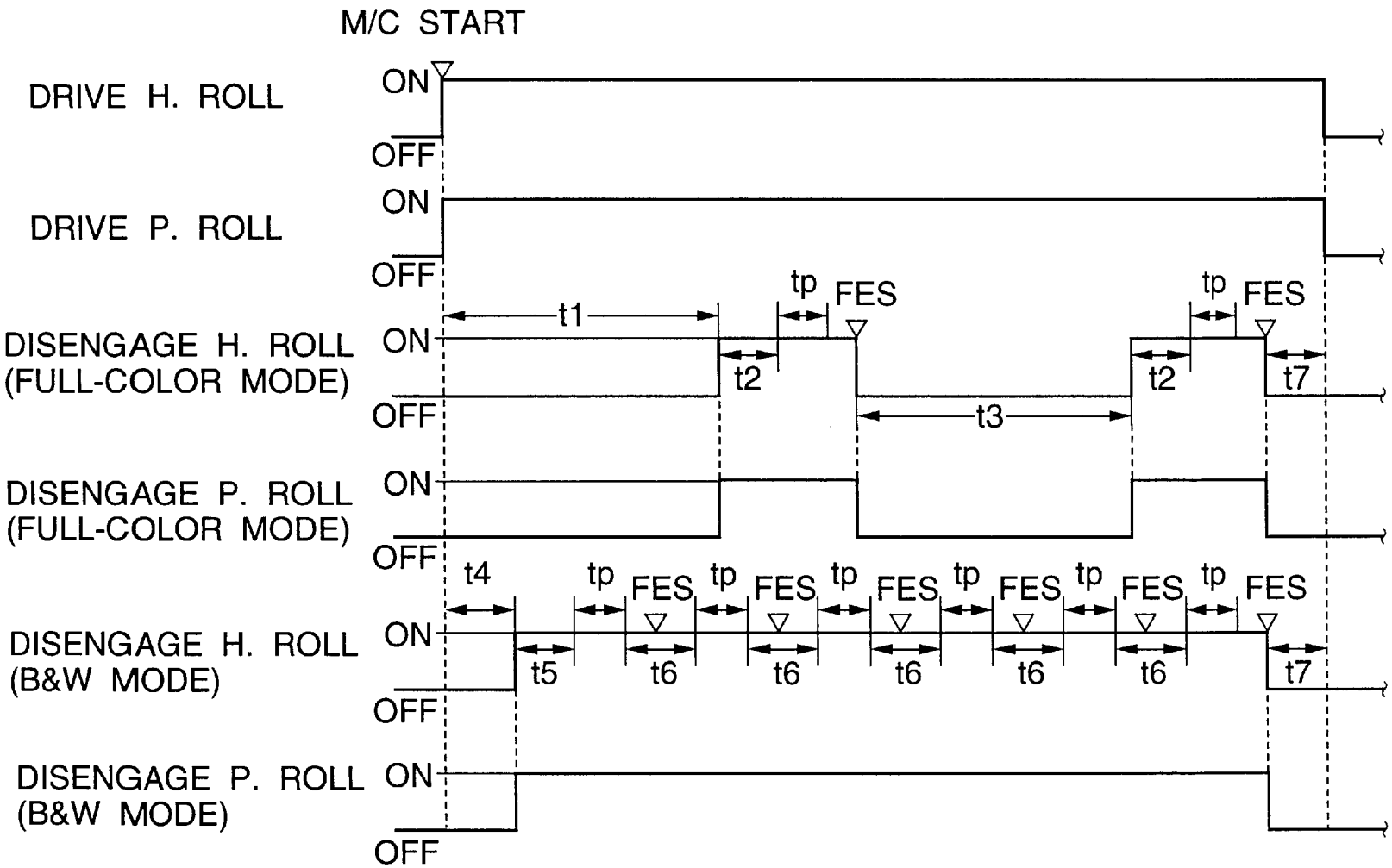
FIG. 17 is a timing chart illustrating the fixing control processing performed in the second embodiment of the invention.

As illustrated in FIG. 17, in the special fixing control processing, the driving motors 121 and 122 for the fixing rolls 70 and 72, respectively, are previously driven according to start of the machine (M/C). After a lapse of a given time of t1 (e.g., 10 sec in the present embodiment), both clutches 123 and 124 are engaged. The rolls 70 and 72 are thus coupled to the driving motors 121 and 122, respectively, and driven by them. After a lapse of a given time of t2 (e.g., 2 sec in the present embodiment), the paper is passed through the nip between both rolls 70 and 72 in a given time of tp. According to the output (FES) from the output sensor 75 that senses the passage of the paper through the nip, both clutches 123 and 124 are disengaged. After a given time of t3 (e.g., 10 sec in the present embodiment), the clutches 123 and 124 are again engaged. The fixing rolls 70 and 72 are coupled to the driving motors 121 and 122 and thus are driven by them. Subsequently, these operations are repeated.

As illustrated in FIG. 17, in the normal fixing control processing, the driving motors 121 and 122 for the fixing rolls 70 and 72, respectively, are previously driven according to start of the machine (M/C). After a lapse of a given time of t4 (e.g., 2.5 sec in the present embodiment), both clutches 123 and 124 are engaged to couple the rolls 70 and 72 to the driving motors 121 and 122, respectively. The rolls are driven by these motors. After a lapse of a given time of t2 (e.g., 2 sec in the present embodiment), the paper is passed through the nip between both rolls 70 and 72 in a given time of tp. Subsequently, the paper is passed through the nip at regular intervals of t6 (e.g., 2.5 sec in the present embodiment). The rolls 70 and 72 are kept coupled to the motors 121 and 122, respectively, until the output (FES) from the output sensor 75 is detected after the final paper has passed.

In the present embodiment, in both full-color mode and black-and-white mode, when a given time of t7 has passed since the output (FES) from the output sensor 75 is detected after the final paper of a given job has passed through the nip between both rolls 70 and 72, these rolls 70 and 72 are deactivated.

Therefore, in the present embodiment, if the full-color mode is selected in the duplex mode, local transfer of an excess of release agent to the intermediate transfer belt 20 via the paper is effectively suppressed similarly to the first embodiment described above. Hence, so-called oil ghost is effectively circumvented.

Third Embodiment

Figure 18:
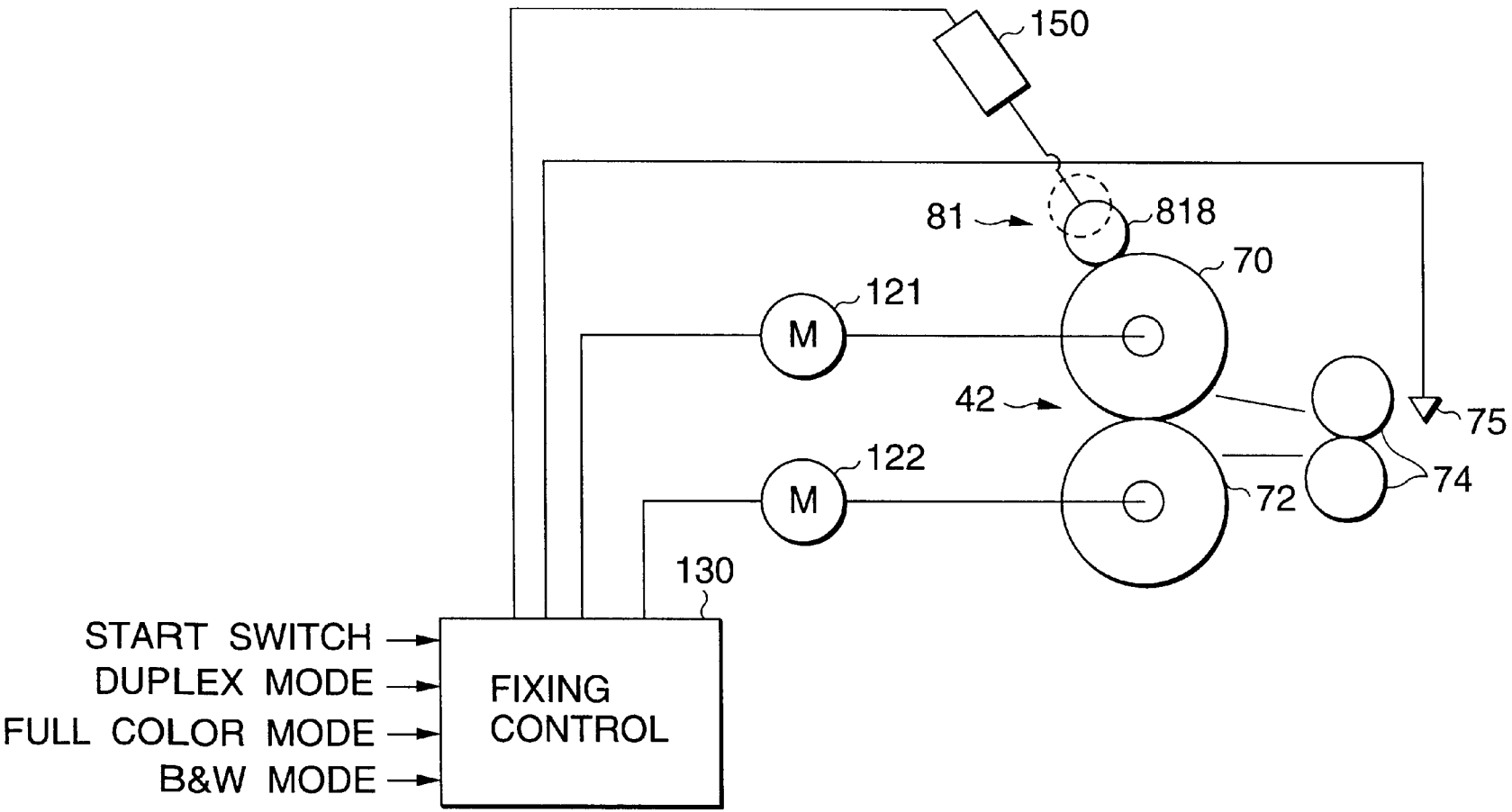
FIG. 18 is a schematic view illustrating a fixing control system used in a fuser in a two-sided imager in accordance with a third embodiment of the invention.

FIG. 18 illustrates the third embodiment of the invention. In this embodiment, the invention is applied to a fuser for a two-sided imager.

The fuser, 42, in accordance with the present invention differs from the fuser used in the first and second embodiments in that the heating fixing roll 70 and the pressure fixing roll 72 are kept in contact with each other. The oil supply device 81 is fitted with an oil roll 818 impregnated with an oil acting as a release agent. The oil is supplied to the oil roll 818 at a constant rate. A clutch 150 holds the oil roll 818 so as to be movable back and forth. The oil roll 818 is brought into and out of engagement with the heating roll 70 at appropriate timing.

The fixing control portion 130 in accordance with the present embodiment executes a fixing control program as illustrated in FIG. 6 according to signals from the start switch and from various mode selector switches and according to the signal from the output sensor 75 of the fuser 42, and send given control signals to the driving motors 121, 122, the clutch 150, and so on. The temperatures of the heaters 71, 73 in the fixing rolls 70 and 72, respectively, and of the heater 821 of the external heating roll 82 are controlled in a manner not illustrated in FIG. 18.

The fixing control processing for the fuser in accordance with the present invention is next described. In the present embodiment, if the full-color mode is selected in the duplex mode, the fixing control portion 130 executes the special fixing control processing. If the black-and-white mode is selected in the duplex mode, the control portion 130 carries out the normal fixing control processing.

Figure 19:
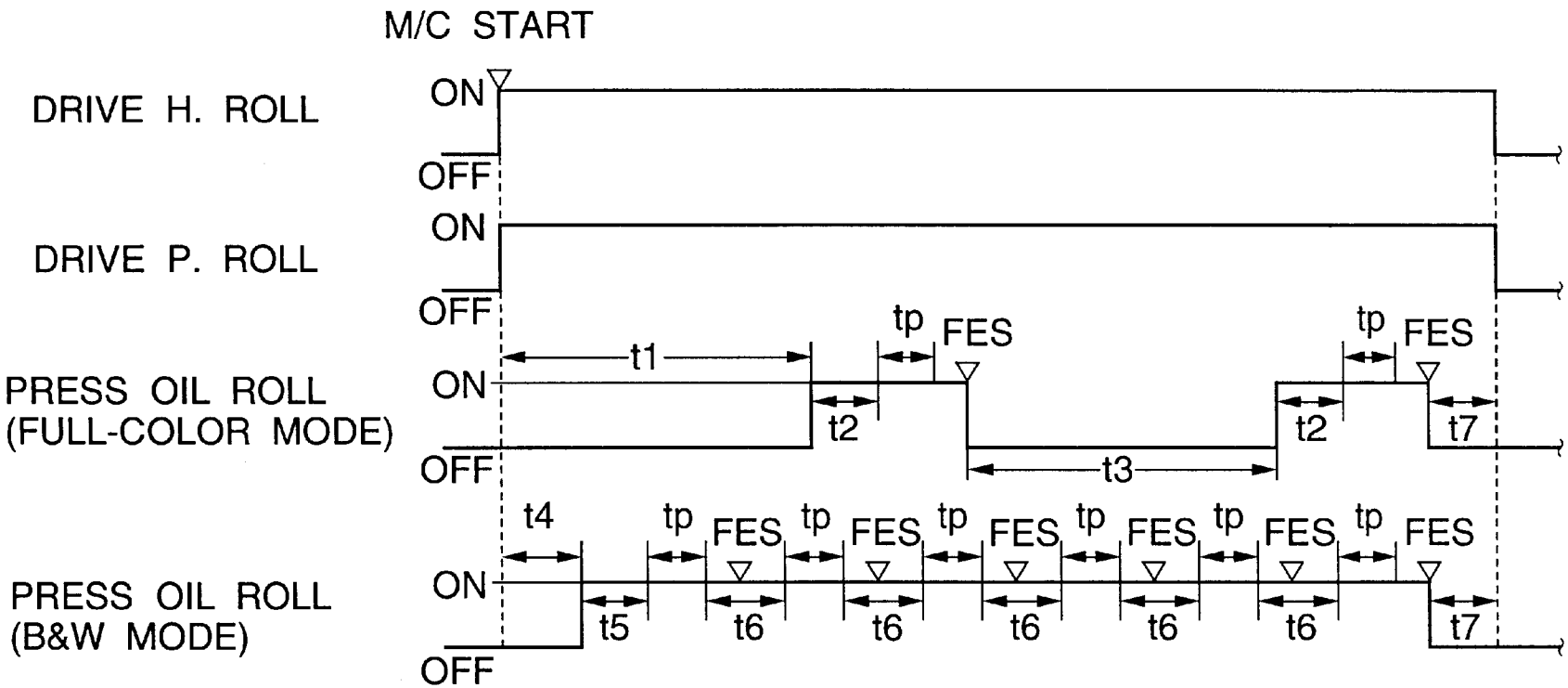
FIG. 19 is a timing chart illustrating the fixing control processing performed in the third embodiment of the invention.

As illustrated in FIG. 19, in the special fixing control processing, the driving motors 121 and 122 for the heating fixing roll 70 and the pressure fixing roll 72 are previously driven in response to start of the machine (M/C). After at least one revolution of the heating roll 70, when a given time of t1 (e.g., 10 sec in the present embodiment) has passed, the clutch 150 brings the oil roll 818 into contact with the heating roll 70, thus nipping the sheet. When a given time of t2 (e.g., 2 sec in the present embodiment) has passed while both rolls 818 and 70 are kept in contact with each other, the sheet is passed through the nip between the rolls 70 and 72 in a given time of tp. The clutch 150 disengages the oil roll 818 and the heating roll 70 from each other according to the output (FES) from the output sensor 75 that senses passage of the sheet through the nip. After a lapse of a given time t3 (e.g., 10 sec in the present embodiment), the clutch 150 again engages the oil roll 818 to the heating roll 70. These operations are subsequently repeated.

In the normal fixing control mode in accordance with the present embodiment, the heating fixing roll 70 and the pressure fixing roll 72 are previously driven by the driving motors 121 and 122 in response to start of the machine (M/C), as illustrated in FIG. 19. After a lapse of a given time of t4 (e.g., 2.5 sec in the present embodiment) since at least one revolution of the heating roll 70, the clutch 150 brings the oil roll 818 into contact with the heating roll 70, thus nipping the sheet. After a lapse of a given time of t5 (e.g., 2 sec in the present embodiment), the paper is passed through the nip between both rolls 70 and 72 in a given time of tp. Subsequently, sheets are passed through at regular intervals of t6 (e.g., 2.5 sec in the present embodiment). The interlocking state between both rolls 818 and 70 is maintained until an output (FES) from the output sensor 75 is detected after the final sheet has passed through the nip.

In the present embodiment, in both full-color mode and black-and-white mode, when a given time t7 has passed since the output (FES) from the output sensor 75 is detected after the final paper of a given job has passed through the nip between both rolls 70 and 72, these rolls 70 and 72 are deactivated.

Therefore, in the present embodiment, if the full-color mode is selected in the duplex mode, local transfer of an excess of release agent to the intermediate transfer belt 20 via the paper is effectively suppressed similarly to the first and second embodiments described above. Hence, so-called oil ghost is effectively circumvented.

Fourth Embodiment

Figure 20:
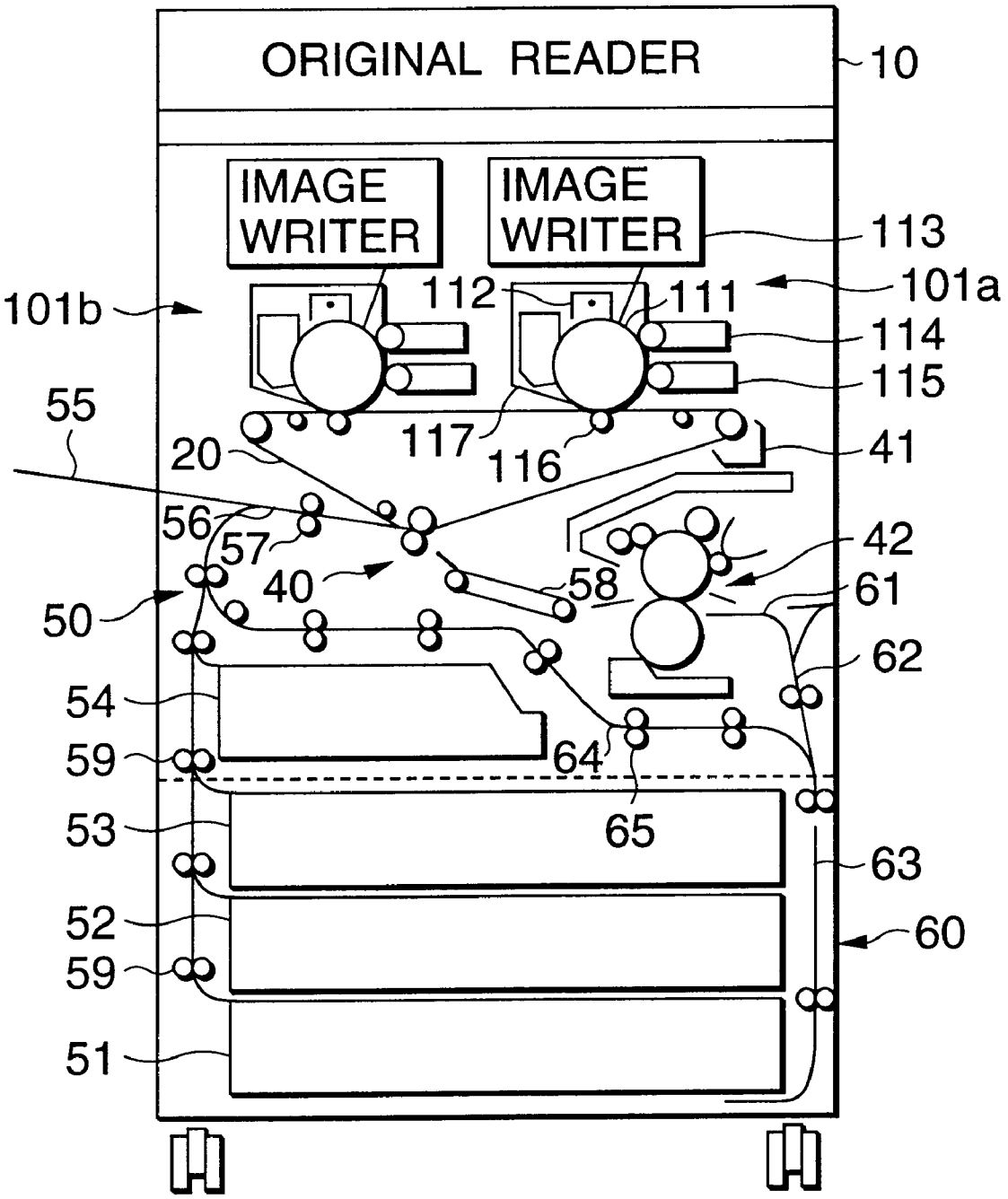
FIG. 20 is a schematic side elevation illustrating a fuser in a two-sided imager in accordance with a fourth embodiment of the invention.
Figure 21A:
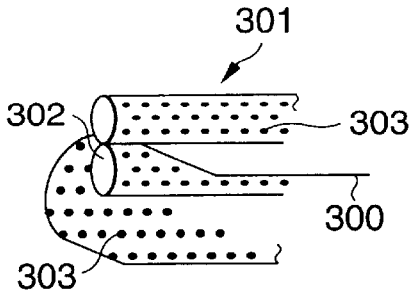
FIGS. 21(*a*)–21(*c*) are fragmentary views illustrating technical problems with the prior art two-sided imager of the intermediate transfer type.
Figure 21B:
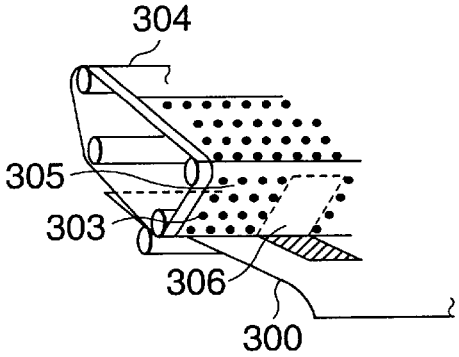
Figure 21C:
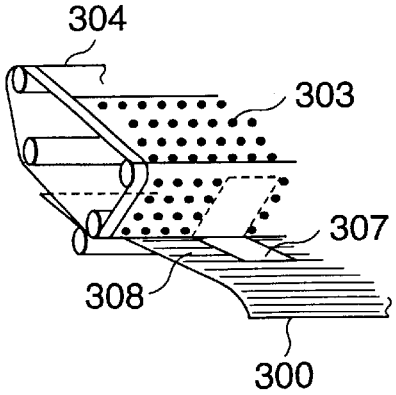

FIG. 20 illustrates a fourth embodiment of the invention. In this embodiment, the invention is applied to a double tandem-type two-sided imager.

This two-sided imager is similar to the imager in accordance with the first embodiment except for the following points. Imaging units 101*a* and 101*b* relying on electrophotography and each capable of forming a two-color component toner image are arranged in a side-by-side relation to the intermediate transfer belt 20. This belt 20 is rotated twice to successively transfer the two-color component toner images formed by the imaging units 101*a* and 101*b* in turn to the intermediate transfer belt 20 (primary transfer). Then, the toner images are transferred at once to the paper by the secondary transfer device 40 (secondary transfer).

Each of the imaging units 101*a* and 101*b* comprises a photoconductor (PC) drum 111, a charger 112, an image writer 113, two developing units 114, 115, a primary transfer device 116, and a drum cleaner 117.

Notice that like components are denoted by like reference numerals in various figures and that those components which have been already described in the first embodiment will not be described below.

In the present embodiment, the intermediate transfer belt 20 differs from the counterpart of the first embodiment in that the belt has two image carrier regions each corresponding to A3 size, for example. Two images of A3 size can be created simultaneously in one imaging cycle.

The double tandem-type two-sided imager in accordance with the present invention carries out the following imaging process in the duplex, full-color mode. If the full-color mode is selected in the auto duplex mode, the imaging controller 100 creates images in the full-color imaging sequence.

In particular, in the first imaging cycle, the intermediate transfer belt makes its first and second revolutions. Whenever the belt 20 makes one revolution, the imaging controller 100 transfers the first-side image S-1 (composite image S-1(YM) of yellow and magenta color components plus composite image S-1 (CK) of cyan and black color components) of the first sheet and the first-side image S-2 (composite image S-2(YM) of yellow and magenta color components plus composite image S-2(CK) of cyan and black color components) of the second sheet to the image carrier regions, respectively of the intermediate transfer belt 20 according to the belt reference signal (the output signal from the mark sensor 92).

When the intermediate transfer belt 20 makes two revolutions, the first side image S-1 (multiple transfer image of the various color components) of the first sheet and the first side image S-2 (multiple transfer image of the various color component) of the second sheet are carried on the image carrier regions of the intermediate transfer belt 20. The images are transferred respectively to the first sides (front surfaces) of the first and second sheets.

Then, the transferred sheets are fixed by the fuser 42. Thereafter, the sheets are transported back to the secondary transfer position via the paper return-and-transport mechanism 60.

Then, the second imaging cycle is carried out by making third and fourth revolutions of the intermediate transfer belt. Whenever the belt 20 makes one revolution, the imaging controller 100 transfers the second side image D-1 (composite image D-1(YM) of yellow and magenta color components plus composite image D-1(CK) of cyan and black color components) of the first sheet and the second side image D-2 (composite image D-2(YM) of yellow and magenta plus composite image D-2(CK) of cyan and black color components) of the second sheet to the image carrier regions, respectively, of the intermediate transfer belt 20 according to the belt reference signal.

When the intermediate transfer belt 20 makes two revolutions, the second side image D-1 (the multiple transfer image of the various color components) of the first sheet and the second side image D-2 (the multiple transfer image of the various color images) of the second sheet are carried on the image carrier regions, respectively, on the belt 20. The two images on the belt 20 are respectively transferred to the second sides (rear surfaces) of the first and second sheets in the secondary transfer position.

Then, the two sheets transfered in succession are fixed by the fuser 42. The sheets fixed in both side are discharged to the output tray (not shown) via the paper output path 61.

In the following imaging cycles, first side images S-i, S-j (j=i+1) or second side images D-i, D-j (j=i+1) are transferred, two at a time, onto the intermediate transfer belt 20. They are then transferred to the first side (front surface) or to the second side (rear surface) of the ith sheet and of the j (i+1) th sheet in the secondary transfer position. Then, the sheets are fixed by the fuser 42.

In this imaging process, a fixing controller (not shown) executes special fixing control mode similar to the special fixing control mode of the first embodiment.

The oil supply conditions in the fuser 42 were examined, and conclusions similar to those of the first embodiment were derived.

In this embodiment, however, the fuser 42 needs to fix two sheets of A3 size, for example, in succession. Therefore, the amount of oil supplied by the oil supply device 81 is required to be set, taking account of the amount of oil absorbed into the previous sheet and the aforementioned oil amount.

As described thus far, the present invention provides a two-sided imager of the intermediate transfer type. The interlocking time of an interlocking mechanism is controlled according to the length of the path of the sheet going to the nip between fixing members in the duplex mode. Therefore, in the mode in which the length of the path of the sheet going to the nip between the fixing members is longer than the maximum allowable length as encountered in the full-color mode, the interlocking time of the interlocking mechanism can be set shorter than an allowable mode corresponding to the maximum allowable length. For example, the amount of release agent to the fixing member located on the rear side of the sheet can be reduced during fixing of the first side image.

Therefore, if a sheet whose first side image has been fixed reaches the sheet transfer location again, the amount of release agent adhering to the area of the sheet opposite to the intermediate transfer body is small. Consequently, the amount of the release agent transferring to the intermediate transfer body can be reduced to a minimum.

In consequence, if the same image is printed or copied continuously in the auto duplex mode and then a wide-area half-toned image is printed in the simplex mode, the release amount difference is not so great. Therefore, so-called oil ghost (i.e., the density of an image area continuously printed in the auto duplex mode becomes much lower than the other areas and this image area appears as a residual image) can be effectively prevented.

What is claimed is:

1. A fuser for use in a two-sided imager having an imaging unit for transferring an unfixed image formed on an image carrier to a sheet via an intermediate transfer body and a sheet return-and-transport mechanism for reversing the sheet whose one side has been fixed and which has been passed through said fuser and for returning said sheet to a sheet transfer location in said imaging unit, said fuser acting to fix unfixed images formed on said sheet by said imaging unit, said fuser acting to separately fix unfixed images formed on both sides of the sheet in turn in duplex mode, said fuser comprising:

a pair of fixing members in contact with each other and rolling over each other, said fixing members cooperating to nip and carry said sheet, said fixing members acting to fix unfixed images on said sheet;

a release agent supply means mounted at least to the fixing member located at a side of the sheet that has an unfixed image, said release agent supply means acting to supply a release agent at a constant rate to the fixing member located at the side of the sheet that has an unfixed image;

an interlocking mechanism for interlocking said fixing members and said release agent supply means in such a way that said fixing members are kept in contact with each other and roll over each other and that the release agent is supplied to the fixing members;

an interlocking control means for controlling interlocking time of said interlocking mechanism, wherein said interlocking control means makes the interlocking time of said interlocking mechanism different between when a first-side image is fixed and when a second-side image is fixed in the duplex mode.

2. The fuser of claim 1, wherein said interlocking mechanism moves said fixing members into and out of contact with each other, and wherein said interlocking mechanism maintains said fixing members and said release agent supply means interlocked when said fixing members are in contact with each other.

3. The fuser of claim 1, wherein said interlocking mechanism drives or deactivates said fixing members while they are in contact with each other, and wherein said interlocking mechanism maintains said fixing members and said release agent supply means interlocked when said fixing members are being driven.

4. The fuser of claim 1, wherein said interlocking mechanism moves said release agent supply means into and out of contact with at least the fixing member located at the side of the sheet that has an unfixed image, and wherein said interlocking mechanism maintains said fixing members and said release agent supply means interlocked when said release agent supply means is in contact with at least the fixing member located at the side of the sheet that has an unfixed image.

5. The fuser of claim 1, wherein said interlocking control means temporarily cancels an interlocking state of said interlocking mechanism if length of the path of the sheet going to a nip between said fixing members exceeds the maximum allowable length in duplex mode.

6. The fuser of claim 1, wherein said interlocking control means continues an interlocking state of said interlocking mechanism after the sheet has passed through said fuser if a monochrome mode is selected in the duplex mode.

7. The fuser of claim 1, wherein said interlocking control means temporarily cancels an interlocking state of said interlocking mechanism after the sheet has passed through said fuser if a full-color mode is selected in duplex mode.

8. The fuser of claim 1, wherein said release agent supply means is mounted only to one of the fixing members located at a side of said sheet carrying the unfixed image.

9. The fuser of claim 1, wherein said interlocking control means controls the interlocking time of said interlocking mechanism such that amounts of release agent at said fixing members become equal at the beginning of use of said fuser.

10. The fuser of claim 1, wherein said interlocking control means controls the interlocking time of said interlocking mechanism in such a way that the amount of release agent at one of said fixing members located on a side of the sheet carrying the unfixed image becomes equal or less than 2.5 $\mu$l/A4 size when second or following sheet passes through said fuser if duplex mode is selected and if the length of the path of the sheet going to a nip between said fixing members is longer than the maximum allowable length.

11. The fuser of claim 1, wherein said interlocking control means controls the interlocking time of said interlocking mechanism in such a way that the amount of release agent at the other of said fixing members located on the opposite side of a surface of the sheet carrying an unfixed image becomes equal or less than 1.5 $\mu$l/A4 size when second or following sheet passes through said fuser if duplex mode is selected and if the length of the path of the sheet going to a nip between said fixing members is longer than the maximum allowable length.

12. A fuser for use in a two-sided imager having an imaging unit for transferring an unfixed image formed on an image carrier to a sheet via an intermediate transfer body and a sheet return-and-transport mechanism for reversing the sheet whose one side has been fixed and which has been passed through said fuser and for returning said sheet to a sheet transfer location in said imaging unit, said fuser acting to fix unfixed images formed on said sheet by said imaging unit, said fuser acting to separately fix unfixed images formed on both sides of the sheet in turn in duplex mode, said fuser comprising:

a pair of fixing members in contact with each other and rolling over each other, said fixing members cooperating to nip and carry said sheet, said fixing members acting to fix unfixed images on said sheet;

a release agent supply means mounted at least to the fixing member located at a side of the sheet that has an unfixed image, said release agent supply means acting to supply a release agent at a constant rate to the fixing member located at the side of the sheet that has an unfixed image;

an interlocking mechanism for interlocking said fixing members and said release agent supply means in such a way that said fixing members are kept in contact with each other and roll over each other and that the release agent is supplied to the fixing members; and an interlocking control means for controlling interlocking time of said interlocking mechanism, wherein (A) a length of the path of the sheet going to a nip between said fixing members in said two-sided imager differs between a full-color mode and a monochrome mode, (B) said interlocking control means sets the interlocking time of said interlocking mechanism to a first time where the full-color mode is selected in duplex mode, (C) said interlocking control means sets said interlocking time to a second time where the monochrome mode is selected, and (D) said first time is set shorter than said second time.

13. The fuser of claim 12, wherein said interlocking mechanism moves said fixing members into and out of contact with each other, and wherein said interlocking mechanism maintains said fixing members and said release agent supply means interlocked when said fixing members are in contact with each other.

14. The fuser of claim 12, wherein said interlocking mechanism drives or deactivates said fixing members while they are in contact with each other, and wherein said interlocking mechanism maintains said fixing members and said release agent supply means interlocked when said fixing members are being driven.

15. The fuser of claim 12, wherein said interlocking mechanism moves said release agent supply means into and out of contact with said fixing members, and wherein said interlocking mechanism maintains said fixing members and said release agent supply means interlocked when said release agent supply means is in contact with said fixing members.

16. The fuser of claim 12, wherein said interlocking control means temporarily cancels an interlocking state of said interlocking mechanism if length of the path of the sheet going to the nip between said fixing members exceeds the maximum allowable length in duplex mode.

17. The fuser of claim 12, wherein said interlocking control means continues an interlocking state of said interlocking mechanism after the sheet has passed through said fuser if the monochrome mode is selected in the duplex mode.

18. The fuser of claim 12, wherein said interlocking control means temporarily cancels an interlocking state of said interlocking mechanism after the sheet has passed through said fuser if the full-color mode is selected in duplex mode.

19. The fuser of claim 12, wherein said release agent supply means is mounted only to one of the fixing members located at a side of said sheet carrying an unfixed image.

20. The fuser of claim 12, wherein said interlocking control means controls the interlocking time of said interlocking mechanism such that amounts of release agent at said fixing members become equal at the beginning of use of said fuser.

21. The fuser of claim 12, wherein said interlocking control means controls the interlocking time of said interlocking mechanism in such a way that the amount of release agent at one of said fixing members located on a side of the sheet carrying an unfixed image becomes equal or less than 2.5 $\mu$l/A4 size when second or following sheet passes through said fuser if duplex mode is selected and if the length of the path of the sheet going to the nip between said fixing members is longer than the maximum allowable length.

22. The fuser of claim 12, wherein said interlocking control means controls the interlocking time of said interlocking mechanism in such a way that the amount of release agent at the other of said fixing members located on the opposite side of a surface of the sheet carrying an unfixed image becomes equal or less than 1.5 $\mu$l/A4 size when second or following sheet passes through said fuser if duplex mode is selected and if the length of the path of the sheet going to the nip between said fixing members is longer than the maximum allowable length.

* * * * *